US011390505B2

(12) United States Patent
Puszkiewicz et al.

(10) Patent No.: US 11,390,505 B2
(45) **Date of Patent: *Jul. 19, 2022**

(54) LIFT DEVICE WITH ARTICULATED BOOM

(71) Applicant: Oshkosh Corporation, Oshkosh, WI (US)

(72) Inventors: Ignacy Puszkiewicz, Hagerstown, MD (US); Michael Indermuhle, Oshkosh, WI (US); Matthew Gilbride, Oshkosh, WI (US)

(73) Assignee: Oshkosh Corporation, Oshkosh, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/027,103

(22) Filed: Sep. 21, 2020

(65) Prior Publication Data

US 2021/0002112 A1 Jan. 7, 2021

Related U.S. Application Data

(63) Continuation of application No. 16/593,271, filed on Oct. 4, 2019, now Pat. No. 10,781,090, which is a (Continued)

(51) Int. Cl.

| | |
|---|---|
| ***B66F 9/06*** | (2006.01) |
| ***B66F 9/065*** | (2006.01) |
| ***B66F 9/075*** | (2006.01) |

(52) U.S. Cl.

CPC ..... *B66F 9/0655* (2013.01); *B66F 9/075* (2013.01); *B66F 9/07559* (2013.01)

(58) Field of Classification Search

None

See application file for complete search history.

(56) References Cited

U.S. PATENT DOCUMENTS 4,775,288 A * 10/1988 Dimitriu ..... B66F 9/0655 414/708
5,609,261 A * 3/1997 Hensler ..... B66F 11/044 212/292

(Continued)

FOREIGN PATENT DOCUMENTS

GB 1-093368 * 11/1964 ..... B66F 11/046
GB 1 330 245 A 9/1973
WO WO-2014/143557 A1 9/2014

OTHER PUBLICATIONS

International Search Report and Written Opinion, PCT Application No. PCT/US2018/049198 dated Dec. 12, 2018, 16 pages.

*Primary Examiner* — Ronald P Jarrett
(74) *Attorney, Agent, or Firm* — Foley & Lardner LLP

(57) ABSTRACT

A frame, a boom assembly, and an actuator. The boom assembly includes a first boom section having a proximal end coupled to the frame and a distal end opposite the proximal end and a second boom section pivotably coupled to the distal end of the first boom section. The actuator is reconfigurable between a locked configuration and an unlocked configuration. The actuator permits the boom assembly to move freely when the actuator is in the unlocked configuration. In the locked configuration, the actuator is positioned to couple the second boom section to the frame such that the actuator limits movement of the first boom section relative to the frame.

20 Claims, 13 Drawing Sheets

Related U.S. Application Data continuation of application No. 16/119,577, filed on Aug. 31, 2018, now Pat. No. 10,457,533.

(60) Provisional application No. 62/553,630, filed on Sep. 1, 2017.

(56) References Cited

U.S. PATENT DOCUMENTS

| | | | | |
|---|---|---|---|---|
| 5,919,027 | A | 7/1999 | Christenson | |
| 5,934,858 | A | 8/1999 | Christenson | |
| 5,934,867 | A | 8/1999 | Christenson | |
| 5,938,394 | A | 8/1999 | Christenson | |
| 5,951,235 | A | 9/1999 | Young et al. | |
| 5,967,731 | A | 10/1999 | Brandt | |
| 5,971,694 | A | 10/1999 | McNeilus et al. | |
| 5,984,609 | A | 11/1999 | Bartlett | |
| 6,033,176 | A | 3/2000 | Bartlett | |
| 6,062,803 | A | 5/2000 | Christenson | |
| 6,089,813 | A | 7/2000 | McNeilus et al. | |
| 6,120,235 | A | 9/2000 | Humphries et al. | |
| 6,123,500 | A | 9/2000 | McNeilus et al. | |
| 6,202,013 | B1 * | 3/2001 | Anderson | B66C 13/40 701/50 |
| 6,210,094 | B1 | 4/2001 | McNeilus et al. | |
| 6,213,706 | B1 | 4/2001 | Christenson | |
| 6,224,318 | B1 | 5/2001 | McNeilus et al. | |
| 6,315,515 | B1 | 11/2001 | Young et al. | |
| 6,336,783 | B1 | 1/2002 | Young et al. | |
| 6,350,098 | B1 | 2/2002 | Christenson et al. | |
| 6,447,239 | B2 | 9/2002 | Young et al. | |
| 6,474,928 | B1 | 11/2002 | Christenson | |
| 6,565,305 | B2 | 5/2003 | Schrafel | |
| 7,070,382 | B2 | 7/2006 | Pruteanu et al. | |
| 7,284,943 | B2 | 10/2007 | Pruteanu et al. | |
| 7,556,468 | B2 | 7/2009 | Grata | |
| 7,559,735 | B2 | 7/2009 | Pruteanu et al. | |
| 7,878,750 | B2 | 2/2011 | Zhou et al. | |
| 8,182,194 | B2 | 5/2012 | Pruteanu et al. | |
| 8,215,892 | B2 | 7/2012 | Calliari | |
| 8,360,706 | B2 | 1/2013 | Addleman et al. | |
| 8,540,475 | B2 | 9/2013 | Kuriakose et al. | |
| 8,807,613 | B2 | 8/2014 | Howell et al. | |
| 9,216,856 | B2 | 12/2015 | Howell et al. | |
| 9,387,985 | B2 | 7/2016 | Gillmore et al. | |
| 9,880,581 | B2 | 1/2018 | Kuriakose et al. | |
| 9,890,024 | B2 | 2/2018 | Hao et al. | |
| 9,981,803 | B2 | 5/2018 | Davis et al. | |
| 10,196,205 | B2 | 2/2019 | Betz et al. | |
| 10,211,055 | B2 | 2/2019 | Bergendahl et al. | |
| 10,336,596 | B2 | 7/2019 | Puszkiewicz et al. | |
| 2009/0206589 | A1 | 8/2009 | Osswald et al. | |
| 2013/0343813 | A1 | 12/2013 | Billaud | |
| 2017/0341860 | A1 | 11/2017 | Dodds et al. | |
| 2018/0026289 | A1 | 1/2018 | Finnerty et al. | |
| 2018/0129241 | A1 | 5/2018 | Kuriakose et al. | |
| 2019/0161272 | A1 | 5/2019 | Betz et al. | |
| 2019/0193934 | A1 | 6/2019 | Rocholl et al. | |

* cited by examiner

LIFT DEVICE WITH ARTICULATED BOOM

CROSS-REFERENCE TO RELATED PATENT APPLICATION

This application is a continuation of U.S. patent application Ser. No. 16/593,271, filed Oct. 4, 2019, which is a continuation of U.S. patent application Ser. No. 16/119,577, filed Aug. 31, 2018, now U.S. Pat. No. 10,457,533, which claims the benefit of U.S. Provisional Patent Application No. 62/553,630, filed Sep. 1, 2017, all of which are incorporated herein by reference in their entireties.

BACKGROUND

Telehandlers are a type of mobile vehicle used to move a payload between the ground and an elevated position and/or between ground-level positions. Telehandlers include a telescoping boom, on the end of which is connected an implement, such as a pair of forks. Conventionally, the boom of a telehandler pivots about a horizontal axis located near the rear end of the telehandler. Such arrangements provide a limited ability to lift material over and beyond an obstacle. By way of example, a conventional telehandler has a limited ability to place material inside of an upper floor of a structure. Rather, conventional telehandlers are limited to placing the material near an external surface of the structure. Further, increasing the maximum lift height of a conventional telehandler requires increasing the overall length of the boom and/or adding additional telescoping sections to the boom. Additionally, in a conventional telehandler, the entire boom is configured to support the weight of the maximum payload despite the fact that, in many circumstances, the weight of the payload carried by the telehandler is a fraction of that of the maximum payload.

SUMMARY

One exemplary embodiment relates to a lift device including a frame, a boom assembly, and an actuator. The boom assembly includes a first boom section having a proximal end coupled to the frame and a distal end opposite the proximal end and a second boom section pivotably coupled to the distal end of the first boom section. The actuator is reconfigurable between a locked configuration and an unlocked configuration. The actuator permits the boom assembly to move freely when the actuator is in the unlocked configuration. In the locked configuration, the actuator is positioned to couple the second boom section to the frame such that the actuator limits movement of the first boom section relative to the frame.

Another exemplary embodiment relates to a lift device including a frame, a boom assembly, and a controller configured to reconfigure the boom assembly between a high lift mode and a high capacity mode. The boom assembly includes a base boom section having a proximal end coupled to the frame and a distal end opposite the proximal end and a telescoping assembly having a proximal end coupled to the base boom section. The base boom section is free to move relative to the frame when the boom assembly is in the high lift mode. The controller is configured to limit movement of the base boom section when the boom assembly is in the high capacity mode. The telescoping assembly is free to move relative to the frame when the boom assembly is in the high capacity mode.

Another exemplary embodiment relates to a boom assembly for a lift device. The boom assembly includes an intermediate boom section, a base boom section, and an upper boom section. The base boom section has a proximal end configured to be coupled to a frame of the lift device and a distal end opposite the proximal end of the base boom section. The distal end of the base boom section is pivotably coupled to the intermediate boom section such that the base boom section rotates about a first axis relative to the intermediate boom section. The upper boom section has a proximal end pivotably coupled to the intermediate boom section such that the upper boom section rotates about a second axis relative to the intermediate boom section. The first axis is offset from the second axis. An actuator is positioned to engage the intermediate boom section to selectively limit movement of the base boom section.

The invention is capable of other embodiments and of being carried out in various ways. Alternative exemplary embodiments relate to other features and combinations of features as may be recited herein.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Figure 1:
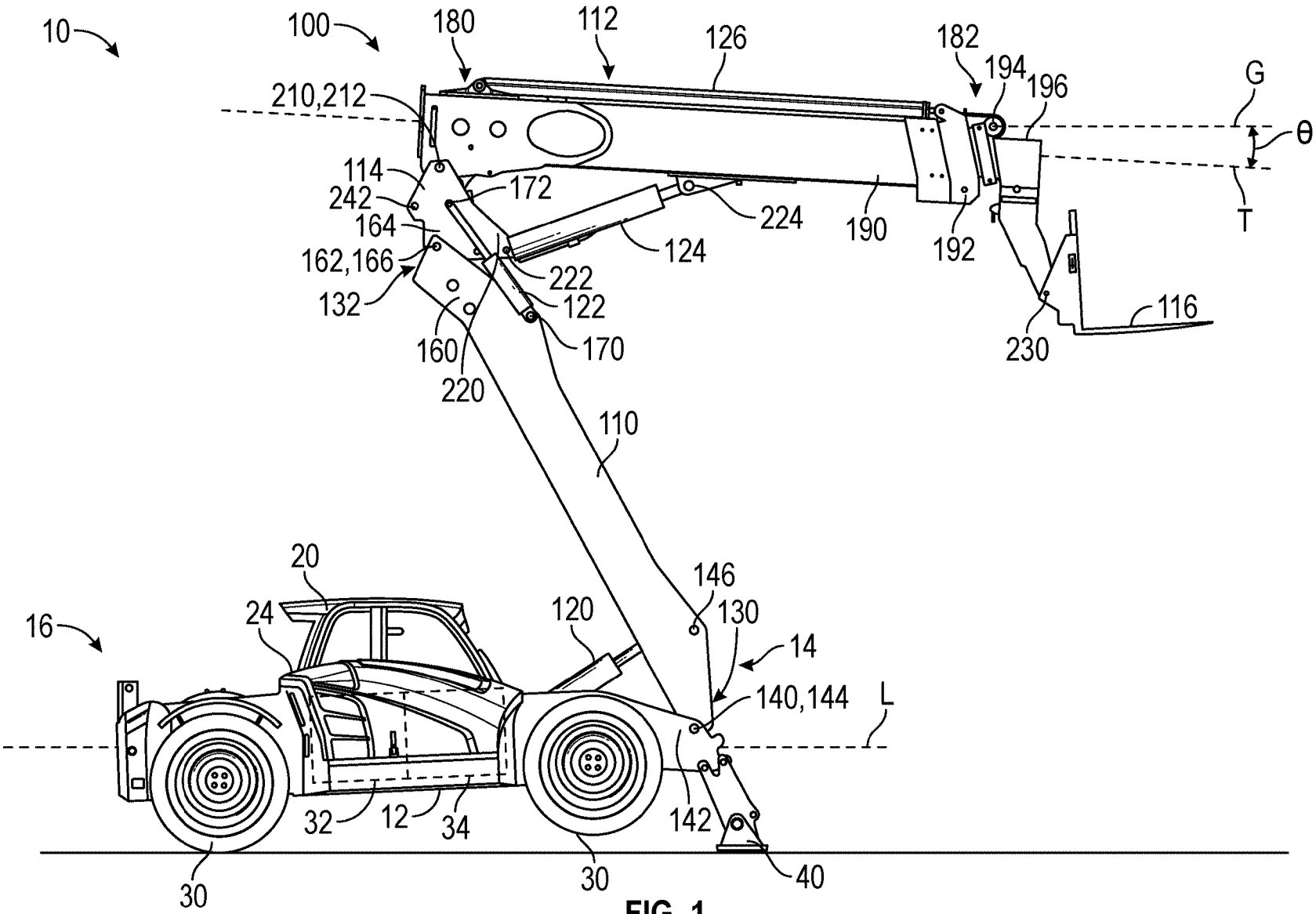
FIG. 1 is a side view of a telehandler, according to an exemplary embodiment.

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

According to an exemplary embodiment, a telehandler includes various components that improve performance relative to traditional systems. The telehandler includes a cabin, from which operation of the telehandler is controlled, and a frame assembly that is supported by a series of tractive elements. A boom assembly is pivotably coupled to the frame assembly near the front end of the frame assembly. The boom assembly includes a tower boom, an intermediate section, a telescoping assembly, and an implement. The tower boom is pivotably coupled to the frame, the intermediate section is pivotably coupled to the tower section, the telescoping assembly is pivotably coupled to the intermediate section, and the implement is coupled to a distal end of the telescoping assembly. The telescoping assembly is configured to extend and retract, moving the implement toward or away from the frame assembly. The implement is a mechanism configured to handle material, such as a pair of forks, a bucket, a grapple, etc. The telehandler includes actuators configured to move each individual section of the boom assembly relative to one another, providing an operator with control over the movement of the boom assembly. In some embodiments, the boom assembly is coupled to a turntable to facilitate further rotation of the boom assembly about a vertical axis.

The telehandler includes a locking mechanism configured to selectively fixedly couple the intermediate section to the frame assembly. With the intermediate section and tower boom in a stored position and the locking mechanism locked, the intermediate section and the tower boom are fixed relative to the frame assembly. The telescoping assembly is free to rotate, extend, and retract normally about a pin connection between the intermediate section and the telescoping assembly. Accordingly, in this configuration, the boom assembly provides similar functionality to that of a conventional telehandler. The telehandler may be configured such that, in this configuration, the telehandler has a greater weight capacity than with the tower boom out of the stored position. With the locking mechanism unlocked, each boom section is free to move in accordance with operator commands. Rotating the tower boom away from the frame assembly elevates the telescoping assembly, facilitating a higher reach with the implement without additional telescoping sections being added to the telescoping assembly. This elevated position of the telescoping assembly also facilitates increased "up and over" capability where the tower boom moves the implement primarily upward and the telescoping assembly moves the implement primarily horizontally. By way of example, the tower boom may lift the telescoping assembly upward such that it can have a near horizontal angle of attack to enter into a structure. Conventional telehandlers are limited in this respect due to the proximity of the pivot point of their telescoping assemblies to the ground. This provides a relatively steep angle of attack that may not be suitable for extending inside of a structure. In some embodiments, the tower boom includes telescoping sections to facilitate further "up and over" capability.

According to the exemplary embodiment shown in FIG. 1, a lift device, shown as telehandler 10, includes a chassis, shown as frame assembly 12, having a front end 14 and a rear end 16. The frame assembly 12 supports an enclosure, shown as cabin 20, that is configured to house an operator of the telehandler 10. The telehandler 10 is supported by a plurality of tractive elements 30 that are rotatably coupled to the frame assembly 12. One or more of the tractive elements 30 are powered to facilitate motion of the telehandler 10. A manipulator, shown as boom assembly 100, is pivotably coupled to the telehandler 10 near the front end 14 of the frame assembly 12. The telehandler 10 is configured such that the operator controls the tractive elements 30 and the boom assembly 100 from within the cabin 20 to manipulate (e.g., move, carry, lift, transfer, etc.) a payload (e.g., pallets, building materials, earth, grains, etc.).

Figure 2:
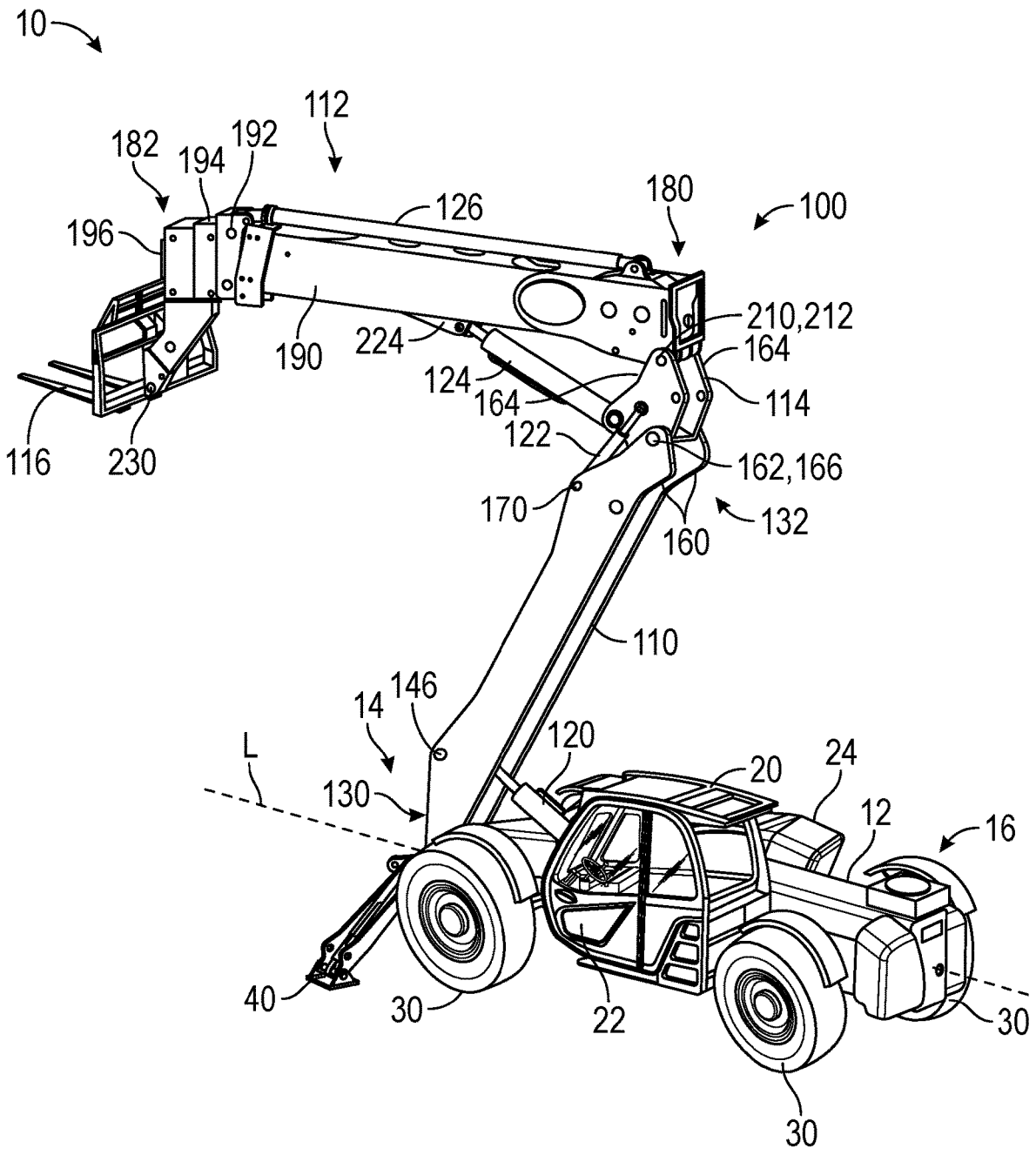
FIG. 2 is a rear perspective view of the telehandler of FIG. 1.

Referring to FIG. 2, the frame assembly 12 defines a longitudinal centerline L that extends along the length of the frame assembly 12. The boom assembly 100 is approximately centered on the longitudinal centerline L to facilitate an even weight distribution between the left and the right sides of the telehandler 10. In one embodiment, the longitudinal centerline and a centerline of the boom assembly 100 are disposed within a common plane (e.g., when the boom assembly 100 is stowed, during movement of the boom assembly 100, etc.). The cabin 20 is laterally offset from the longitudinal centerline L. The cabin 20 includes a door 22 configured to facilitate selective access into the cabin 20. The door 22 may be located on the lateral side of the cabin 20 opposite the boom assembly 100. An enclosure, shown as housing 24, is coupled to the frame assembly 12. The housing 24 is laterally offset from the longitudinal centerline L in a direction opposite the cabin 20. The housing 24 contains various components of the telehandler 10 (e.g., the primary driver 32, the pump 34, a fuel tank, a hydraulic fluid reservoir, etc.). The housing 24 may include one or more doors to facilitate access to components of the primary driver 32 or the pump 34.

Each of the tractive elements 30 may be powered or unpowered. Referring to FIG. 1, telehandler 10 includes a powertrain system including a primary driver 32 (e.g., an engine). The primary driver 32 may receive fuel (e.g., gasoline, diesel, natural gas, etc.) from a fuel tank and combust the fuel to generate mechanical energy. According to an exemplary embodiment, the primary driver 32 is a compression-ignition internal combustion engine that utilizes diesel fuel. In alternative embodiments, the primary driver 32 is another type of device (e.g., spark-ignition engine, fuel cell, etc.) that is otherwise powered (e.g., with gasoline, compressed natural gas, hydrogen, etc.). As shown in FIG. 1, a hydraulic pump, shown as pump 34, receives the mechanical energy from the primary driver 32 and provides pressurized hydraulic fluid to power the tractive elements 30 and the other hydraulic components of the telehandler 10 (e.g., the lower actuator 120, the intermediate actuator 122, etc.). The pump 34 may provide a pressurized flow of hydraulic fluid to individual motive drivers (e.g., hydraulic motors) configured to facilitate independently driving each of the tractive elements 30 (e.g., in a hydrostatic transmission configuration). In such embodiments, the telehandler 10 also includes other components to facilitate use of a hydraulic system (e.g., reservoirs, accumulators, hydraulic lines, valves, flow control components, etc.). In other embodiments, the primary driver 32 provides mechanical energy to the tractive elements 30 through another type of transmission. In yet other embodiments, the telehandler 10 includes an energy storage device (e.g., a battery, capacitors, ultracapacitors, etc.) and/or is electrically coupled to an outside source of electrical energy (e.g., a standard power outlet coupled to the power grid). In some such embodiments, one or more of the tractive elements 30 include an individual motive driver (e.g., a motor that is electrically coupled to the energy storage device, etc.) configured to facilitate independently driving each of tractive elements 30. The outside source of electrical energy may charge the energy storage device or power the motive drivers directly.

Referring to FIG. 1, the telehandler 10 includes a pair of supports, shown as outriggers 40. The outriggers 40 are selectively repositionable between a stored position and a deployed position, shown in FIG. 1. In some embodiments, the outriggers 40 are slidably coupled to the frame assembly 12. In other embodiments, the outriggers 40 are pivotably coupled to the frame assembly 12. In the stored position, the outriggers 40 are raised above the ground to facilitate free motion of the telehandler 10. In the deployed position, the outriggers 40 contact the ground, supporting a portion of the weight of the telehandler 10. The outriggers 40 increase the overall size of the footprint of the telehandler 10 that contacts the ground, further increasing the tip resistance of the telehandler 10. The outriggers 40 may each include an actuator (e.g., a hydraulic cylinder, a motor, etc.) configured to move the outriggers 40 between the stored position and the deployed position. As shown in FIG. 1, the outriggers 40 are configured to raise the front end 14 off the ground. In other embodiments, another set of outriggers 40 lift the rear end 16 alternately or in addition to the front end 14.

Referring again to FIG. 1, the boom assembly 100 includes a lower boom section, shown as tower boom 110, an upper boom section, shown as telescoping assembly 112, an intermediate boom section, shown as intermediate section 114, coupling the tower boom 110 to the telescoping assembly 112, and an implement 116 coupled to the telescoping assembly 112. The boom assemblies may be made from any material (e.g., steel, aluminum, composite, etc.) with any cross section (e.g., square tube, I-beam, C-channel, round tube, etc.) that provides sufficient structural integrity to support the desired payload. Each boom section may include additional components (e.g., side plates, bosses, bearings, sliders, etc.) that facilitate connection to one another and to other components as described herein.

Referring to FIG. 1, the various boom sections are configured to be articulated by a series of actuators, including a first actuator, shown as lower actuator 120, a second actuator, shown as intermediate actuator 122, a third actuator, shown as upper actuator 124, and a fourth actuator, shown as telescoping actuator 126. The actuators are configured to control the boom assembly 100 to lift or otherwise manipulate various loads. As shown in FIG. 1, the actuators are hydraulic cylinders powered by pressurized fluid from the pump 34 that extend and retract linearly. In such embodiments, the hydraulic cylinders each include a body that defines an interior volume and receives a shaft. A piston is connected to the shaft and engages an interior surface of the body, dividing the interior volume of the body into a pair of chambers. Pressurized hydraulic fluid is selectively pumped (e.g., by pump 34) into each of the chambers to selectively expand or contract the hydraulic cylinder. The hydraulic cylinders may include bosses, devises, or other features to facilitate interfacing with other components (e.g., the frame assembly 12, the boom sections, etc.). In other embodiments, the actuators are another type of linear actuator (e.g., electrical, pneumatic, etc.) or are rotary actuators. According to the embodiment shown in FIG. 1, each of the boom sections and actuators rotate and translate within the plane of FIG. 1.

FIGS. 1-5 show the tower boom 110, according to an exemplary embodiment. The tower boom 110 extends along a longitudinal axis from a first or proximal end 130 to a second or distal end 132. Near the proximal end 130, the tower boom 110 defines one or more interfaces, shown as apertures 140. Near the front end 14 of the frame assembly 12, the frame assembly 12 includes a pair of plates 142 spaced equally apart from the longitudinal centerline L. The plates 142 each define one or more interfaces, shown as apertures 144. As shown in FIG. 1, the apertures 144 are concentric with one another. The proximal end 130 of the tower boom 110 is received between the plates 142 such that the apertures 140 and the apertures 144 are aligned. In other embodiments, the tower boom 110 defines a pair of plates that receive a portion of the frame assembly 12 therebetween. A pin member (e.g., a pin, a dowel, a bolt, a shaft, an axle, etc.) extends through the apertures 140 and the apertures 144, pivotably coupling the frame assembly 12 and the tower boom 110. In some embodiments, the pin member is captured (e.g., using a cotter pin that extends through the pin member, using a feature on the pin itself, etc.) relative to the frame assembly 12. Accordingly, the tower boom 110 is configured to rotate relative to the frame assembly 12 about a laterally-extending axis extending through the centers of the apertures 140 and the apertures 144.

Figure 3:
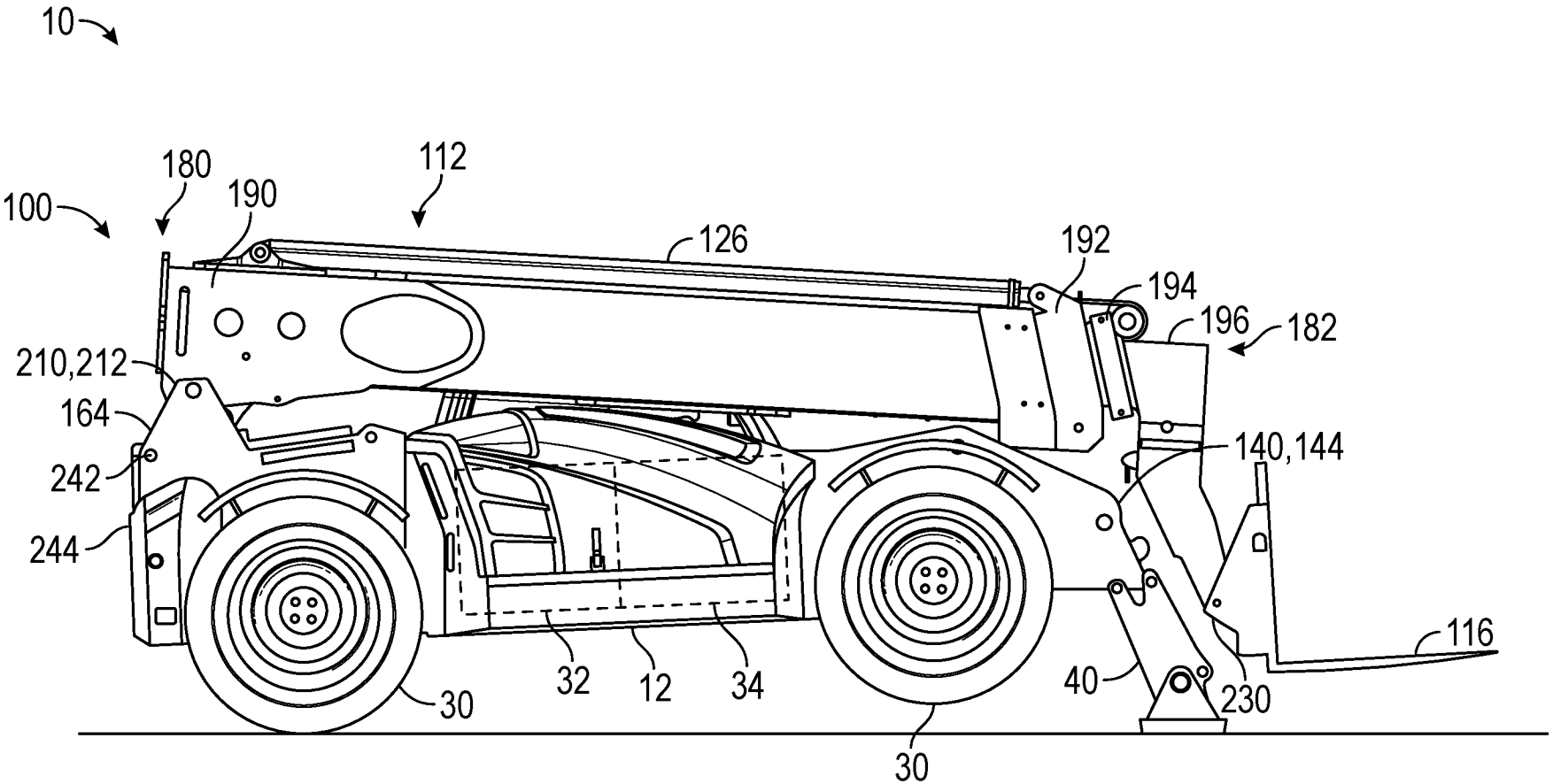
FIG. 3 is another side view of the telehandler of FIG. 1.

The tower boom 110 is rotatable relative to the frame assembly 12 between a stored position (e.g., as shown in FIG. 3), where the tower boom 110 extends approximately horizontally proximate the frame assembly 12, and a fully extended position, where the tower boom 110 is rotated away from the frame assembly 12. In use, the operator controls the tower boom 110 to rotate to a use position, which may be any position between and including the stored and fully extended positions. The exact location of the use position may vary throughout operation of the telehandler 10. The lower actuator 120 is configured to rotate the tower boom 110 between the stored position, the use position, and the fully extended position. Upon extension of the lower actuator, the tower boom 110 is moved away from the stored position and toward the fully extended position. The fully extended position is defined where the lower actuator 120 can no longer extend (e.g., due to a finite stroke length, due to controls-induced limits, due to a physical stop, etc.).

Referring to FIG. 1, the lower actuator 120 is pivotably coupled to the frame assembly 12 at one end and to the tower boom 110 at a second end opposite the first end. The frame assembly 12 defines one or more apertures that correspond with an aperture (e.g., defined in a boss) in the first end of the lower actuator 120. A pin member extends through these corresponding apertures, pivotably coupling the lower actuator 120 and the frame assembly 12. The tower boom 110 defines one or more interfaces, shown as apertures 146, that correspond with an aperture (e.g., defined in a clevis) in the second end of the lower actuator 120. A pin member extends through the apertures 146 and through the corresponding aperture in the lower actuator 120, pivotably coupling the tower boom 110 and the lower actuator 120. As shown in FIG. 1, the lower actuator 120 extends through a first side of the tower boom 110 and connects to the apertures 146 proximate an opposing side of the tower boom 110. Accordingly, a portion of the tower boom 110 may be shaped to facilitate free movement of the lower actuator 120 relative to the tower boom 110. In other embodiments, the telehandler 10 includes two or more lower actuators 120, each located on either side of the tower boom 110. Placing a lower actuator 120 on both sides of the tower boom 110 prevents introducing a twisting moment load upon the tower boom 110.

Referring to FIGS. 1 and 2, the tower boom 110 includes a pair of panels 160 near the distal end 132 that are spaced apart from one another. In some embodiments, the panels 160 are spaced apart an equal distance from the longitudinal centerline L. In some embodiments, the panels 160 are configured to rest upon the frame assembly 12 when the tower boom 110 is in the stored position. Near the distal end 132, the tower boom 110 defines one or more interfaces, shown as apertures 162. In some embodiments, the apertures 162 are defined in the panels 160. The intermediate section 114 includes a pair of panels 164 spaced apart from one another. The panels 164 may be separate, or the intermediate section 114 may include one or more supporting members extending between the panels 164, coupling the panels 164 together and strengthening the intermediate section 114. In some embodiments, the panels 164 are spaced apart an equal distance from the longitudinal centerline L. The panels 164 each define one or more interfaces, shown as apertures 166. As shown in FIG. 1, the panels 164 are received between the panels 160 such that the apertures 162 are aligned with the apertures 166. In other embodiments, the panels 160 are received between the panels 164. The apertures 162 and 166 receive one or more pin members, pivotably coupling the intermediate section 114 to the distal end 132 of the tower boom 110. Accordingly, the intermediate section 114 is configured to rotate relative to the tower boom 110 about a laterally-extending axis extending through the centers of the apertures 162 and the apertures 166.

The intermediate section 114 is rotatable relative to the tower boom 110 between a stored position, shown in FIG. 3, and a fully extended position. In use, the operator controls the intermediate section 114 to rotate to a use position (e.g., as shown in FIG. 1), which may be any position between and including the stored and fully extended positions. The exact location of the use position may vary throughout operation of the telehandler 10. In the stored position, the intermediate section 114 is rotated toward the tower boom 110. In the use position, the intermediate section 114 is rotated away from the tower boom 110. In the embodiment shown in FIGS. 1-5, the telehandler 10 includes two intermediate actuators 122, each disposed on an opposite side of the longitudinal centerline L. The intermediate actuators 122 are configured to rotate the intermediate section 114 between the stored position and the fully extended position. Upon extension of the intermediate actuators 122, the intermediate section 114 is moved away from the stored position and toward the fully extended position. The fully extended position is defined where the intermediate actuators 122 can no longer extend (e.g., due to a finite stroke length, due to controls-induced limits, due to a physical stop, etc.).

Referring again to FIG. 1, each intermediate actuator 122 is pivotably coupled to the tower boom 110 at a first end and to a panel 164 of the intermediate section 114 at a second end opposite the first end. The tower boom 110 defines one or more interfaces, shown as apertures 170, that correspond with an aperture (e.g., defined in a boss) in the first end of each of the intermediate actuators to receive a pin member, pivotably coupling the intermediate actuators 122 and the tower boom 110. Each panel 164 of the intermediate section 114 defines one or more interfaces, shown as apertures 172, that correspond with an aperture (e.g., defined in a clevis) in the second end of each of the intermediate actuators 122. One or more pin members extend through the aperture 172 and through the corresponding apertures in the intermediate actuators 122, pivotably coupling the intermediate section 114 and the intermediate actuator 122. As shown in FIG. 1, the intermediate actuators 122 each extend proximate an outside surface of the intermediate section 114. This facilitates clearance between the intermediate actuators 122 and the upper actuator 124. In other embodiments, the telehandler 10 includes one or more intermediate actuators 122 that extend between the panels 164.

FIGS. 1-6 show the telescoping assembly 112, according to an exemplary embodiment. The telescoping assembly 112 extends along a longitudinal axis from a first or proximal end 180 to a second or distal end 182. The telescoping assembly 112 includes one or more telescoping boom sections that telescope relative to one another to vary an overall length of the telescoping assembly 112. According to the exemplary embodiment shown in FIG. 1, the telescoping assembly 112 includes a base boom section or base section 190, a first mid boom section or first mid section 192, a second mid boom section or second mid section 194, and a fly boom section or fly section 196. The base section 190 receives the first mid section 192, the first mid section 192 receives the second mid section 194, and the second mid section 194 receives the fly section 196. Accordingly, each successive section may be smaller than the previous one to facilitate nesting. The telescoping assembly 112 may include sliders, bearings, spacers, or other components to facilitate sliding motion between each of the sections.

Figure 6:
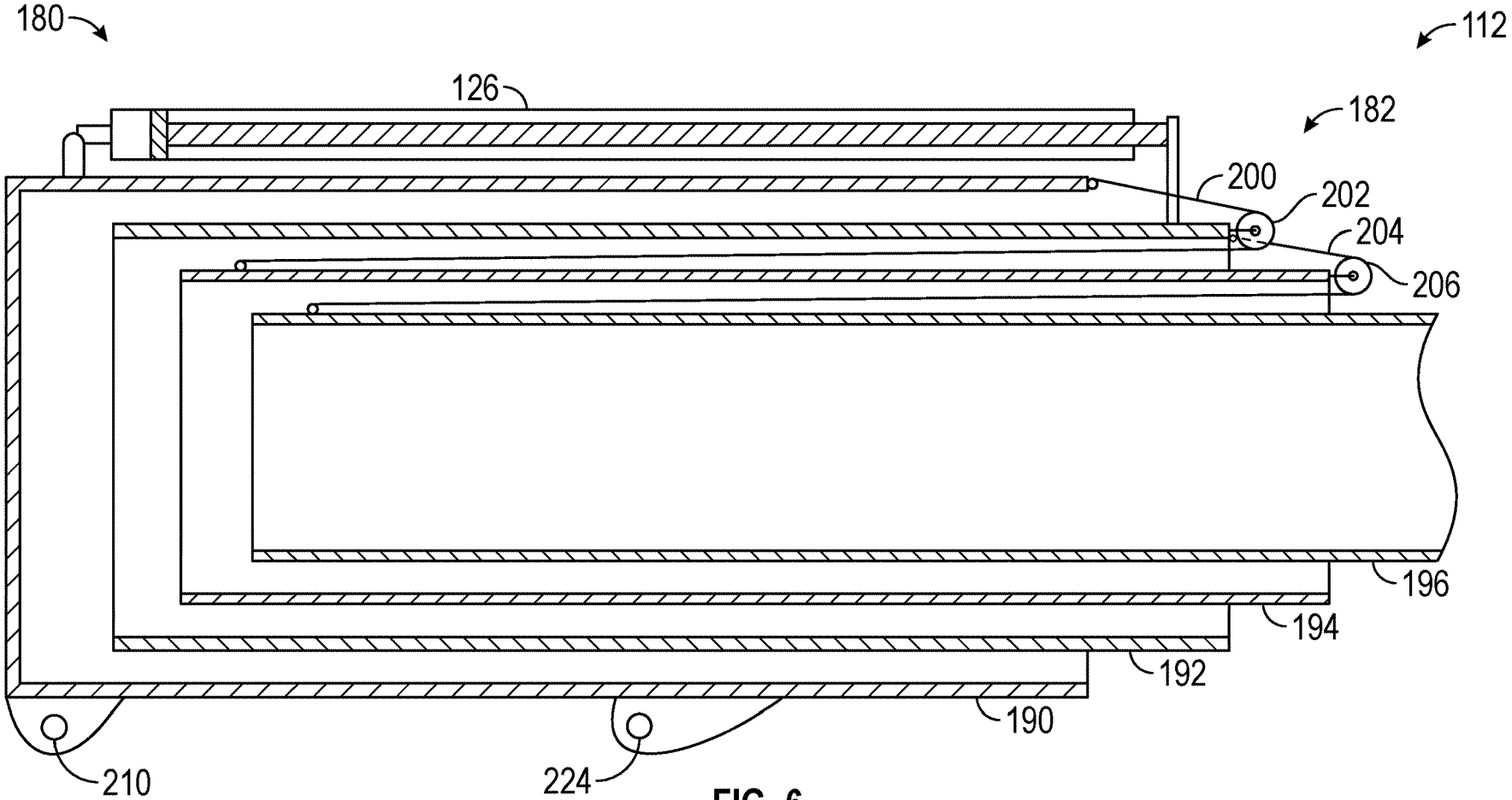
FIG. 6 is a section view of a telescoping assembly of the telehandler of FIG. 1, according to an exemplary embodiment.

As shown in FIG. 6, the telescoping actuator 126 is coupled to the base section 190 at a first end and coupled to the first mid section 192 at a second end opposite the first end. As shown in FIG. 6, the telescoping actuator 126 is positioned outside of the base section 190. In other embodiments, the telescoping actuator 126 is positioned within the base section 190. The telescoping actuator 126 facilitates extension and retraction of the telescoping assembly 112. The telescoping actuator 126 extends the first mid section 192 when extending and retracts the first mid section 192 when retracting. A cable 200 couples the base section 190 to the proximal end of the second mid section 194, running over a pulley 202 coupled to the first mid section 192. A cable 204 couples the first mid section 192 to the proximal end of the fly section 196, running over a pulley 206 coupled to the second mid section 194. Accordingly, extending the telescoping actuator 126 produces tension on the cable 200 and the cable 204, extending the second mid section 194 and the fly section 196 simultaneously with the first mid section 192. In some embodiments, the telescoping assembly 112 includes a different number of (e.g., greater or fewer) telescoping boom sections. In other embodiments, the telescoping assembly 112 uses a different telescoping arrangement. By way of example, the telescoping assembly 112 may include additional cables to facilitate powered retraction of the telescoping boom sections.

Figure 4:
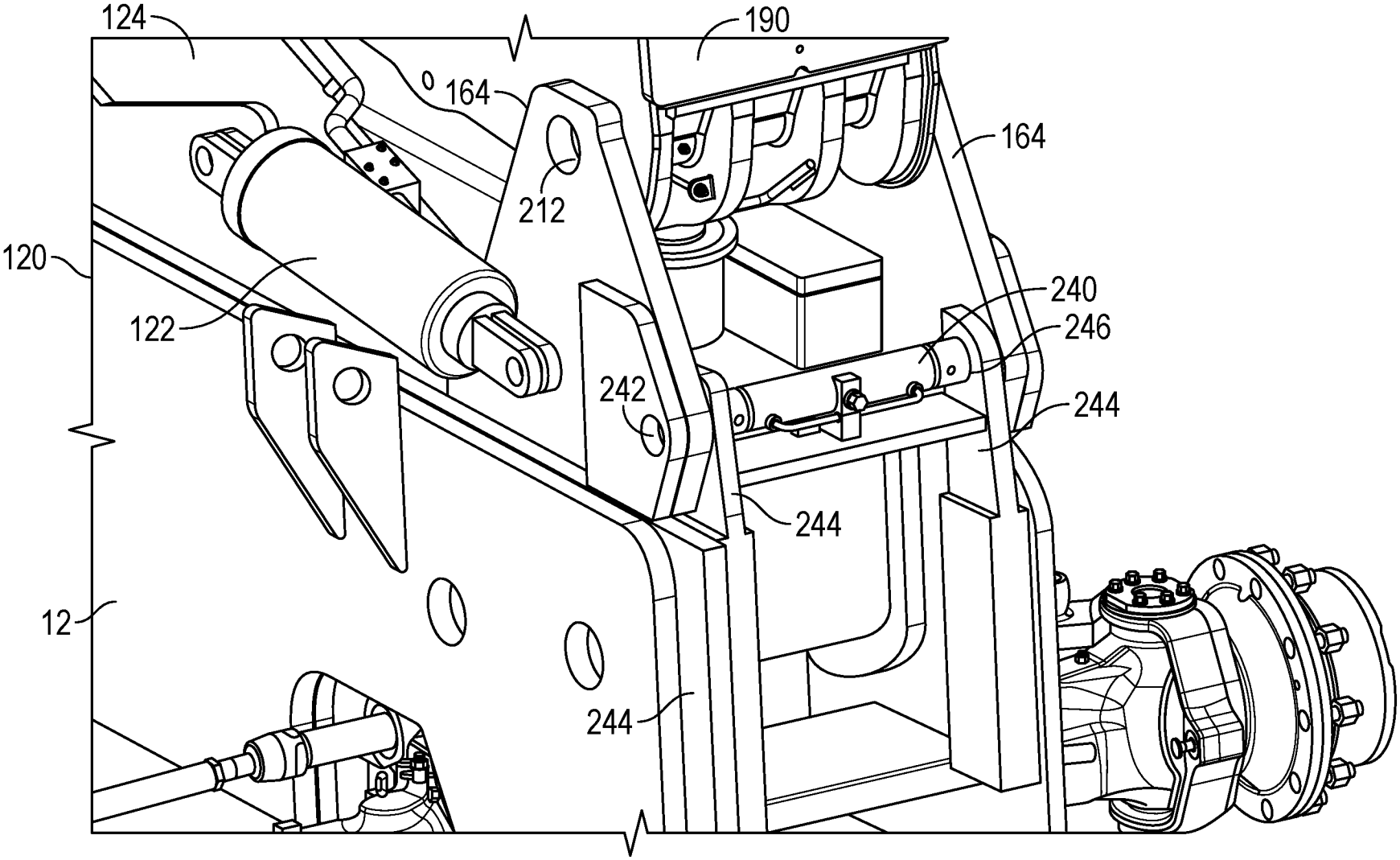
FIG. 4 is a rear perspective view of a locking mechanism of the telehandler of FIG. 1, according to an exemplary embodiment.
Figure 5:
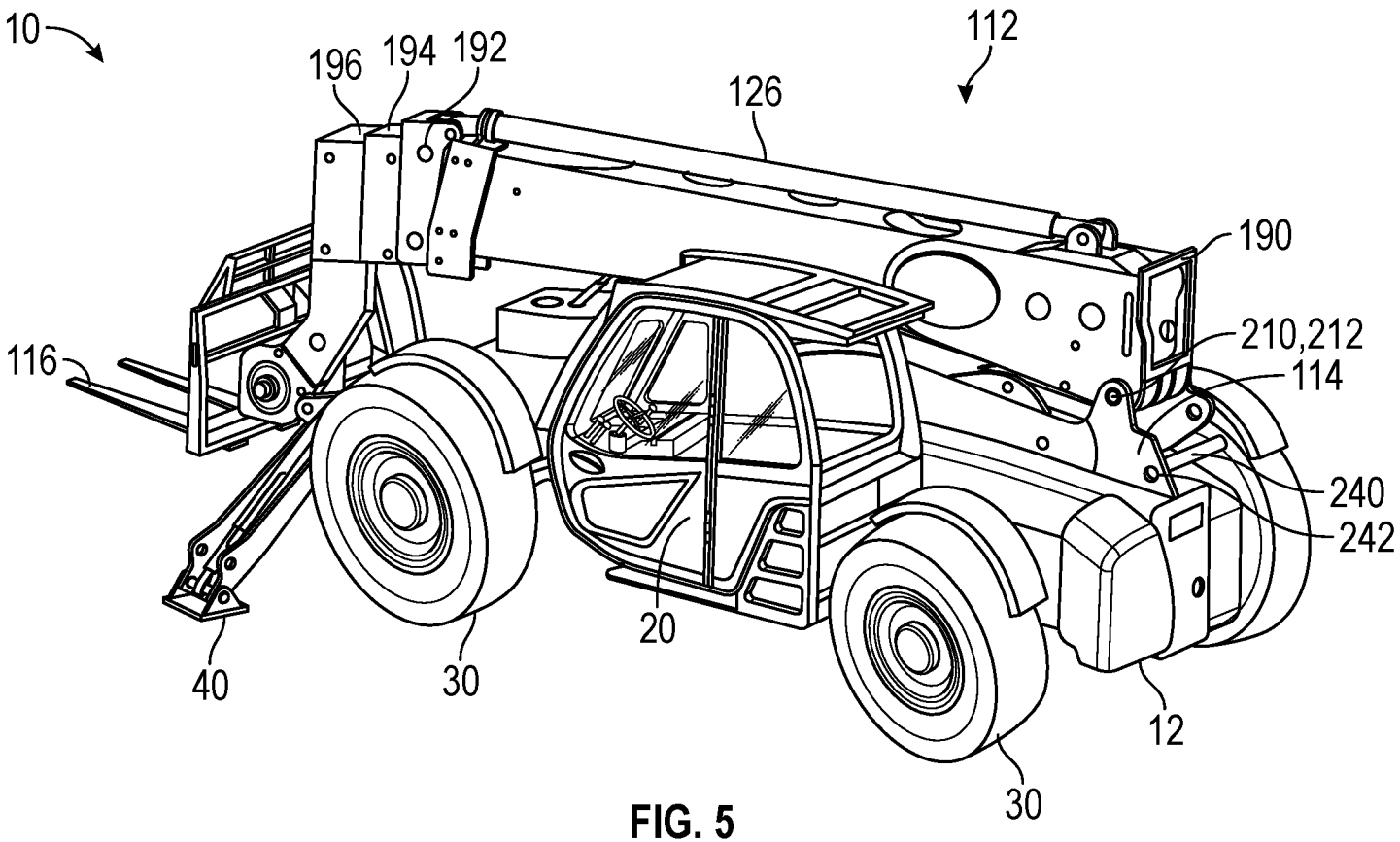
FIG. 5 is a rear perspective view of the telehandler of FIG. 1.

Referring again to FIG. 1, near the proximal end 180, the base section 190 defines one or more interfaces, shown as apertures 210. Each panel 164 of the intermediate section 114 defines an interface, shown as aperture 212 that corresponds with the apertures 210. As shown in FIGS. 2 and 4, the proximal end 180 of the telescoping assembly 112 is received between the panels 164 such that the apertures 210 are aligned with the apertures 212. In other embodiments, the base section 190 includes a pair of plates that receive the intermediate section 114 therebetween having a similar alignment of the apertures 210 and the apertures 212. The apertures 210 and the apertures 212 receive one or more pin members, pivotably coupling the telescoping assembly 112 to the intermediate section 114. Accordingly, the telescoping assembly 112 is configured to rotate relative to the intermediate section 114 about a laterally-extending axis extending through the centers of the apertures 210 and the apertures 212.

The telescoping assembly 112 is rotatable relative to the intermediate section 114 between a stored position, shown in FIG. 3, and a fully extended position. A use position is located at or between the stored position and the fully extended position. The exact location of the use position may vary throughout operation of the telehandler 10. In the stored position, the telescoping assembly 112 is rotated toward the tower boom 110 and toward the frame assembly 12. In the fully extended position, the telescoping assembly 112 is rotated away from the tower boom 110 and the frame assembly 12. As shown in FIG. 3, with the tower boom 110, the intermediate section 114, and the telescoping assembly 112 all in the stored position, the telescoping assembly 112 extends approximately parallel to or angled slightly downward in relation to the frame assembly 12. In the embodiment shown in FIGS. 1-5, the telehandler 10 includes one upper actuator 124, disposed in approximately the same vertical plane as the longitudinal centerline L. In other embodiments, the upper actuator 124 is located elsewhere and/or the telehandler 10 includes multiple upper actuators 124. The upper actuator 124 is configured to rotate the telescoping assembly 112 between the stored position, the fully extended position, and the use position. Upon extension of the upper actuator, the telescoping assembly 112 is moved away from the stored position and toward the fully extended position. The fully extended position is defined where the upper actuator 124 can no longer extend (e.g., due to a finite stroke length, due to controls-induced limits, due to a physical stop, etc.).

Referring to FIG. 1, the upper actuator 124 is pivotably coupled to a portion or member 220 of the intermediate section 114 at a first end and to the telescoping assembly 112 at a second end opposite the first end. The member 220 extends between the panels 164 and is coupled to the panels 164. The member 220 defines one or more interfaces, shown as apertures 222, that correspond with an aperture (e.g., defined in a boss) in the first end of the upper actuator 124 to receive a pin member, pivotably coupling the upper actuator 124 and the intermediate section 114. The base section 190 of the telescoping assembly 112 defines one or more interfaces, shown as apertures 224, that correspond with an aperture (e.g., defined in a clevis) in the second end of the upper actuator 124. A pin member extends through the apertures 224 and through the corresponding aperture in the upper actuator 124, pivotably coupling the telescoping assembly 112 and the upper actuator 124.

Referring to FIG. 1, the implement 116 is coupled to the distal end of the fly section 196 of the telescoping assembly 112 with an interface 230. The implement 116 may be any type of mechanism used to support, grab, or otherwise interact with the payload. The implement 116 may include one or more of a carriage and/or set of forks (e.g., pallet forks, bale forks, etc.), a bucket, a grapple or grab (e.g., a bale grab, a log grab, a shear grab, a grab for use in combination with a bucket, etc.), a boom (e.g., a boom supporting a cable used to manipulate roof trusses), an auger, a concrete bucket, and another type of implement. The interface 230 extends between the fly section 196 and the implement 116, coupling the implement 116 to the telescoping assembly 112. In some embodiments, the interface 230 is a quick disconnect mechanism that facilitates attaching and detaching various implements 116 to and from the fly section 196, facilitating using the telehandler 10 in multiple types of situations. As shown in FIG. 3, the fly section 196 may extend downward, bringing the implement 116 closer to the ground to facilitate interaction with a payload on the ground. In some embodiments, the telehandler 10 includes actuators to facilitate articulating (e.g., pivoting, rotating, translating, etc.) the implement 116 relative to the fly section 196. In some embodiments, the telehandler 10 includes components to facilitate powering the implement 116. By way of example, hydraulic lines may run through or along the boom assembly 100 to provide pressurized hydraulic fluid from the pump 34 to the implement 116. By way of another example, wires may run through or along the boom assembly 100 to provide electrical power to the implement 116.

Referring to FIG. 1, the telescoping assembly 112 is defined as having an angle of attack θ. The angle of attack θ is defined as the angle between a plane G that extends parallel to the ground or other support surface of the telehandler 10 and an axis T along which the telescoping assembly 112 extends and retracts. The angle of attack θ provides an indication of the absolute orientation of the telescoping assembly 112. A negative angle of attack θ indicates that the telescoping assembly 112 is pointing toward the ground, and a positive angle of attack θ indicates that the telescoping assembly 112 is pointing away from the ground. An angle of attack θ of zero indicates that the telescoping assembly 112 is parallel to the ground.

The telehandler 10 is configured to be operated in at least two modes of operation including a high capacity mode and a high lift mode. In the high capacity mode, the tower boom 110 and the intermediate section 114 remain in their respective stored positions. In some embodiments, the lower actuator 120 and the intermediate actuator 122 are used to hold the tower boom 110 and the intermediate section 114 stationary. As shown in FIG. 3, in the high capacity mode, the telescoping assembly 112 pivots near the rear end 16 of the frame assembly 12 and pivots at approximately the height of the frame assembly 12. Accordingly, the angle of attack θ may be limited in the negative direction due to interference between the telescoping assembly 112 and the frame assembly 12 or the tower boom 110. In the high capacity mode, the upper actuator 124 and the telescoping actuator 126 are used to rotate and telescope the telescoping assembly 112, respectively, to manipulate the implement 116 and any payload supported by the implement 116. When lifting, the outriggers 40 may be moved to the deployed position to further stabilize the telehandler 10. According to one example of how the high capacity mode may be used, an operator may use the telehandler 10 to move a hay bale into storage. An operator may drive the telehandler 10 up to a hay bale with the telescoping assembly 112 in the stored position and fully collapsed. With the implement 116 near the ground, the operator may control the boom assembly 100 and/or the tractive elements 30 to engage the implement 116 with the hay bale. The operator may then rotate the telescoping assembly 112 upward, away from the frame assembly 12 and extend the telescoping assembly 112 to move the hay bale upward into a structure for storage.

In the high lift mode, an operator controls the rotational movement of the tower boom 110, the intermediate section 114, and the telescoping assembly 112 and the extension and retraction of the telescoping assembly 112. The lower actuator 120 is used to rotate the tower boom 110 relative to the frame assembly 12. The intermediate actuator 122 is used to rotate the intermediate section 114 relative to the tower boom 110. The upper actuator 124 is used to rotate the telescoping assembly 112 relative to the intermediate section 114. The telescoping actuator 126 is used to extend and retract the telescoping assembly 112. As shown in FIGS. 1-3, rotating the tower boom 110 away from the stored position elevates the telescoping assembly 112 and moves the point of rotation of the telescoping assembly 112 forward. One or both of the intermediate actuator 122 and the upper actuator 124 are used to rotate the telescoping assembly 112 upward or downward. In the high lift mode, the angle of attack θ may reach much larger negative values than in the high capacity mode due to the elevated position of the telescoping assembly 112. Multiple actuators may be activated simultaneously to maintain a desired angle of attack θ.

In the high lift mode, the boom assembly 100 can reach a greater maximum load placing height (e.g., 70') than in the high capacity mode due to the added elevation of the telescoping assembly 112 provided by the tower boom 110. Conventionally, to reach such a distance, additional telescoping sections would be added to a boom assembly, increasing the complexity of the boom assembly, or the boom assembly would be lengthened, increasing the overall length of the telehandler. Additionally, in the high lift mode, the telehandler 10 has "up and over" capability that is not available in conventional telehandlers. By way of example, in some instances, it is desirable to move a payload onto an upper floor of a structure from the exterior of the structure. Conventional telehandlers require a very steep angle of attack to reach an upper floor of a structure with a telescoping boom coupled directly to a frame. Such a steep angle of attack is not suitable for moving a payload into an upper floor of a structure, as further extension of the boom into the building results in the implement being raised a significant amount, potentially colliding with part of the structure above the desired floor. Because the tower boom 110 of the telehandler 10 elevates the telescoping assembly 112, the angle of attack θ required to reach a given floor is closer to zero than that of a conventional telehandler. This shallow angle of attack θ facilitates extending the implement 116 further into a structure than a conventional telehandler for a given increase in elevation of the implement 116.

In some embodiments, the telehandler 10 is configured to support a greater load (i.e., more weight) when in the high capacity mode than when in the high lift mode. In many applications, the extended reach and "up and over" capability of the high lift mode are not necessary. In some such applications, the telehandler 10 is required to support a relatively large load. Accordingly, to suit such applications, it is desirable to increase the capacity of the components used in the high capacity mode compared to the components used only in the high lift mode. This reduces the weight and cost of the telehandler 10 without significantly affecting the performance of the telehandler 10. In such embodiments, the tower boom 110, lower actuator 120, and intermediate actuators 122 may be configured to support a lesser load (e.g., may be made with less material, may be configured to output a lesser force, etc.) than the telescoping assembly 112 and the upper actuator 124. Placement of the tower boom 110 and the intermediate section 114 near the frame assembly 12 also lowers the center of gravity of the telehandler 10, further increasing the tip resistance of the telehandler 10. Accordingly, a capacity of the boom assembly 100 (e.g., the maximum weight of the payload that the implement 116 can support) is greater in the high capacity mode than in the high lift mode.

Referring to FIG. 4, the telehandler 10 includes a locking mechanism 240. The locking mechanism 240 is coupled to the frame assembly 12 and is actuatable between a locked configuration and an unlocked configuration. In some embodiments, the locking mechanism 240 includes a hydraulic actuator. Each of the panels 164 of the intermediate section 114 defines an aperture, shown as aperture 242. With the tower boom 110 and the intermediate section 114 in their respective stored positions, the apertures 242 are configured to align with the locking mechanism 240. In the locked configuration, a pair of pins extend laterally outward from a body of the locking mechanism 240 to extend into and/or through the apertures 242, engaging the intermediate section 114 and locking the boom assembly 100 in the high capacity configuration. When in the locked configuration, the locking mechanism 240 fixedly couples the tower boom 110 and the intermediate section 114 to the frame assembly 12, causing the tower boom 110 and the intermediate section 114 to act as members of the frame assembly 12. This significantly increases the strength of the frame assembly 12, further increasing the capacity of the telehandler 10 in the high capacity mode. In the unlocked configuration, the pins retract into the body, and the boom assembly 100 is free to move. In some embodiments, the frame assembly 12 includes a pair of plates 244 that extend between the panels 164 of the intermediate section 114 and the locking mechanism 240. The pins of the locking mechanism 240 extend through an aperture 246 defined by each plate 244 and into and/or through the apertures 242 such that force applied to the pins by the intermediate section 114 is applied directly to the plates 244 instead of passing through the body of the hydraulic actuator and into the frame assembly 12. In some embodiments, the pins of the locking mechanism 240 engage the tower boom 110 directly instead of or in addition to the intermediate section 114.

Figure 7:
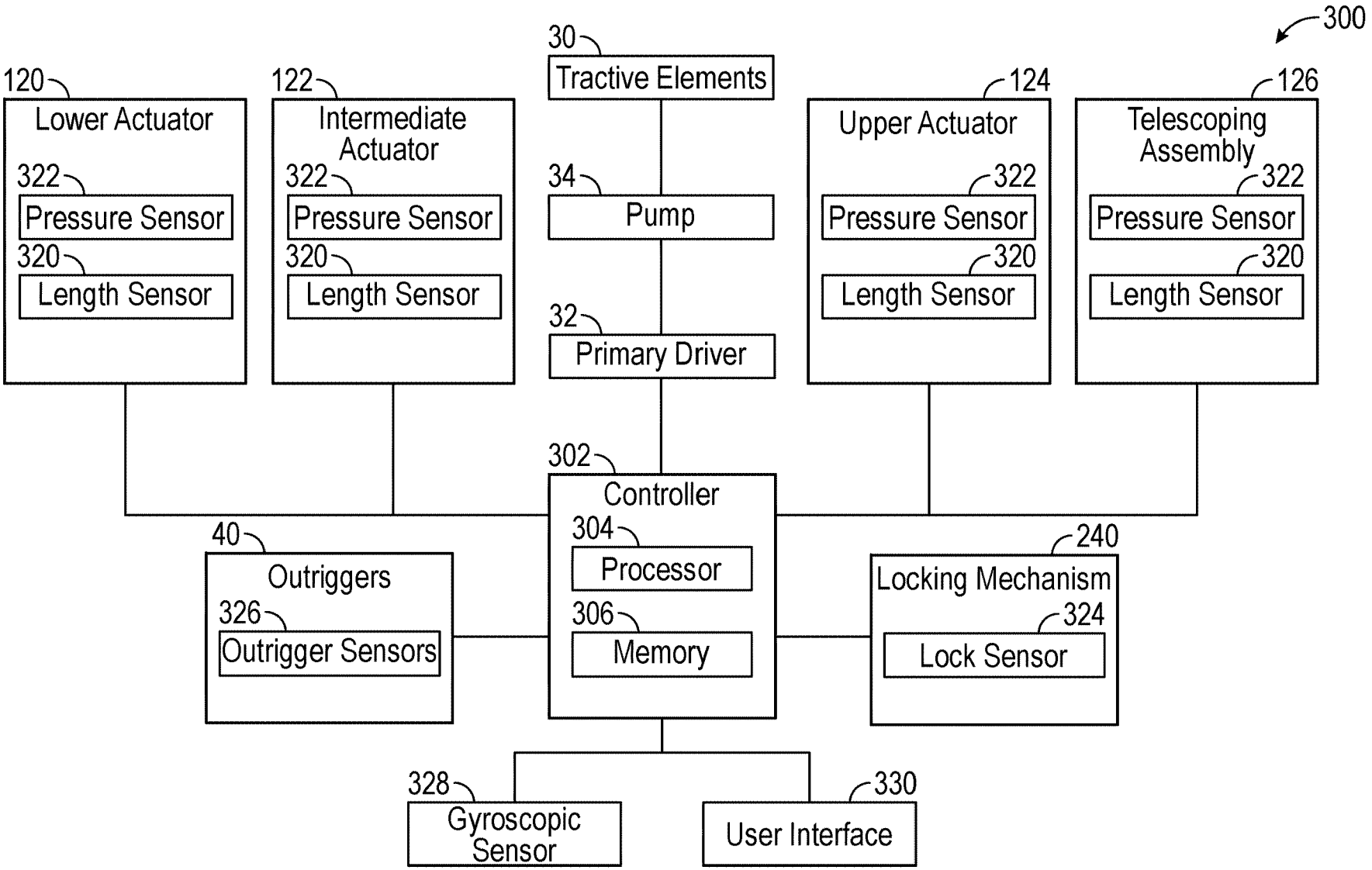
FIG. 7 is a block diagram illustrating a control system of the telehandler of FIG. 1, according to an exemplary embodiment.

Referring to FIG. 7, the telehandler 10 includes a control system 300 configured to control the operation of the telehandler 10. The control system 300 includes a controller 302 including a processor 304 and a memory 306. The processor 304 is configured to issue commands to and process information from other components. The processor 304 may be implemented as a specific purpose processor, an application specific integrated circuit (ASIC), one or more field programmable gate arrays (FPGAs), a group of processing components, or other suitable electronic processing components. The memory 306 is one or more devices (e.g., RAM, ROM, flash memory, hard disk storage) for storing data and computer code for completing and facilitating the various user or client processes, layers, and modules described in the present disclosure. The memory 306 may be or include volatile memory or non-volatile memory and may include database components, object code components, script components, or any other type of information structure for supporting the various activities and information structures of the inventive concepts disclosed herein. The memory 306 is communicably connected to the processor 304 and includes computer code or instruction modules for executing one or more processes described herein.

Referring again to FIG. 7, the controller 302 controls the operation of the lower actuator 120, the intermediate actuator 122, the upper actuator 124, the telescoping actuator 126, the primary driver 32, and the locking mechanism 240. Although some connections are not shown in FIG. 7, it should be understood that the pump 34 and/or the primary driver 32 may be configured to provide power to the actuators, the outriggers 40, the tractive elements 30, and the locking mechanism 240. In some embodiments, the controller 302 interfaces with valves that control the flow of hydraulic fluid to the various hydraulically-powered components of the telehandler 10. The controller 302 is configured to receive information from length sensors 320 and pressure sensors 322 in each actuator, a lock sensor 324 coupled to the locking mechanism 240, one or more outrigger sensors 326 coupled to the outriggers 40, a gyroscopic sensor 328, and a user interface 330. The user interface 330 may be configured to provide information to and receive information from an operator. Accordingly, the user interface 330, may include screens, buttons, switches, joysticks, or other conventional types of interface devices. The user interface 330 may be disposed within the cabin 20.

The controller 302 is configured to use the length sensors 320 to determine a current length of each of the actuators. The length sensors 320 may be sensors configured to sense a length of each actuator directly (e.g., a linear variable differential transformer) or sensors configured to sense other information usable to determine a length of each actuator indirectly (e.g., a rotary potentiometer measuring an angular position of a boom section). In some embodiments, the geometry of the boom assembly 100 is used to generate a mathematical model relating the current length of each of the actuators to an orientation and position of each part of the boom assembly 100. The controller 302 may use this information in a closed-loop control system controlling the actuation of the boom assembly 100. By way of example, the controller 302 may be configured to maintain a desired angle of attack θ of the telescoping assembly 112 while raising or lowering the telescoping assembly 112.

In some embodiments, the control system 300 includes pressure sensors 322 configured to measure a current pressure of the hydraulic fluid within each of the actuators. In some embodiments, the geometry of the boom assembly 100 is used to generate a mathematical model relating the current pressure in each of the actuators to the weight of the payload supported by the implement 116. In other embodiments, the controller 302 uses a different type of sensor to determine the weight of the payload. By way of example, the control system 300 may include one or more load cells on the pins of the locking mechanism 240 that sense the weight applied to the pins by the tower boom 110 or intermediate section 114. The controller 302 may use the current orientation and position of each part of the boom assembly 100 in addition to the information from these various types of sensors when determining the weight of the payload.

The controller 302 may be configured to include an interlock system that selectively prevents switching from the high capacity mode to the high lift mode. Before changing to the high lift mode, the controller 302 may check a series of conditions. If any of these conditions are not met, the controller 302 may prevent entering the high lift mode (e.g., by preventing reconfiguring of the locking mechanism 240 to the unlocked configuration, by preventing movement of the lower actuator 120 and the intermediate actuators 122, etc.). The lock sensor 324 is configured to determine if the locking mechanism 240 is in the unlocked configuration or the locked configuration. The controller 302 may check if the weight of the payload is above a predetermined threshold weight. If the weight is above this value, the controller 302 may prevent the telehandler 10 from changing to the high lift mode. The controller 302 may use the outrigger sensors 326 to determine if the outriggers 40 are in the deployed position and supporting the telehandler 10. Accordingly, the outrigger sensors 326 may measure the position of the outriggers 40 and/or the weight supported by the outriggers. If the outriggers 40 are not in the correct position or are not supporting enough weight (e.g., experiencing less than a threshold force), the controller 302 may prevent the telehandler 10 from changing to the high lift mode. The gyroscopic sensor 328 may be configured to determine an absolute angular orientation of the telehandler 10 (i.e., an orientation of the telehandler 10 relative to the direction of gravity). Accordingly, the gyroscopic sensor 328 may be fixedly coupled to the frame assembly 12. If the telehandler 10 is outside a predetermined range of absolute angular orientations (e.g., more than a threshold angle offset from a level orientation (e.g., in the roll direction, in the pitch direction, etc.)), the controller 302 may prevent the telehandler 10 from changing to the high lift mode. This interlock system limits the potential of the telehandler 10 to tip and prevents the tower boom 110, the intermediate section 114, the lower actuator 120, and the intermediate actuators 122 from being overloaded.

Figure 8:
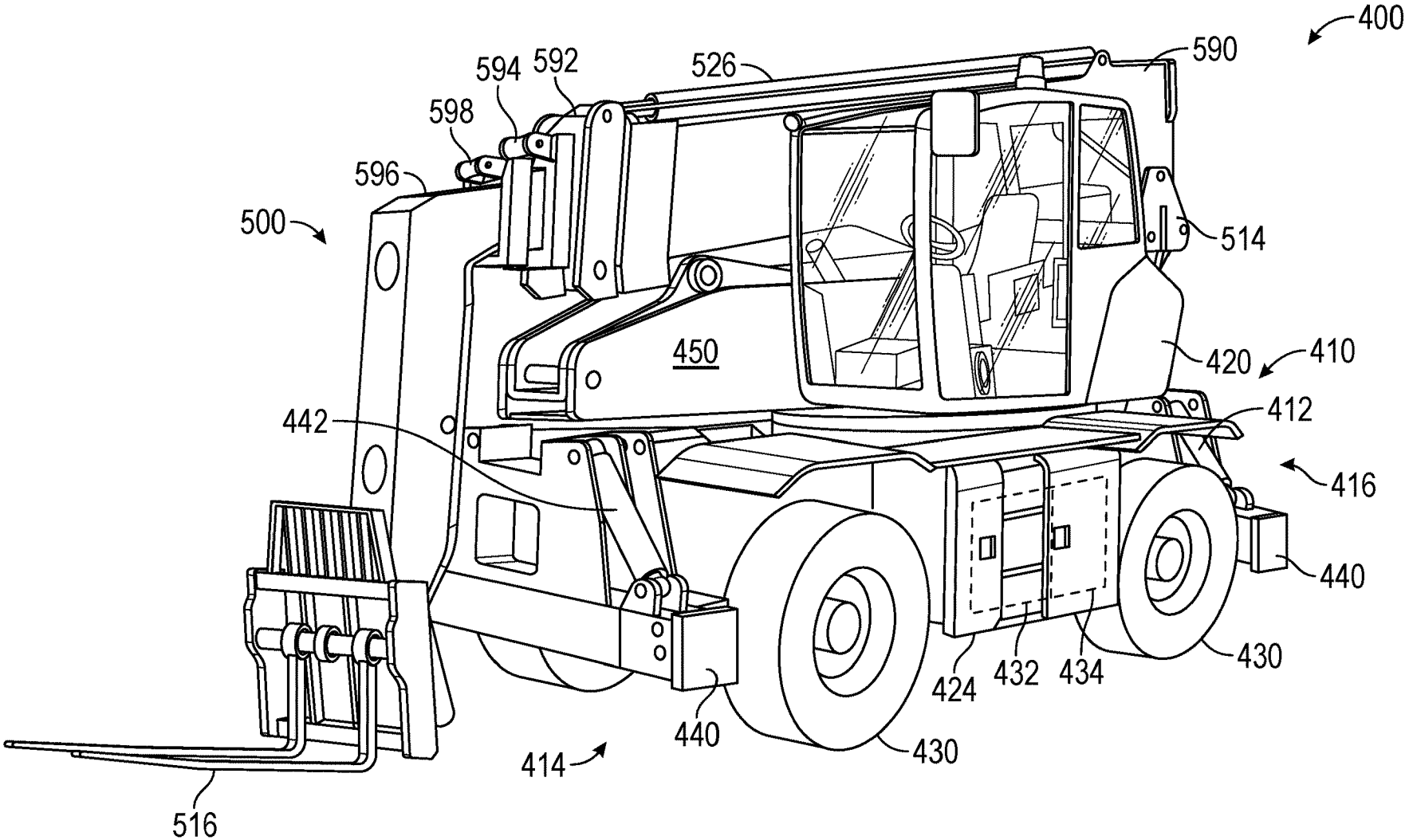
FIG. 8 is a front perspective view of a telehandler, according to another exemplary embodiment.
Figure 9:
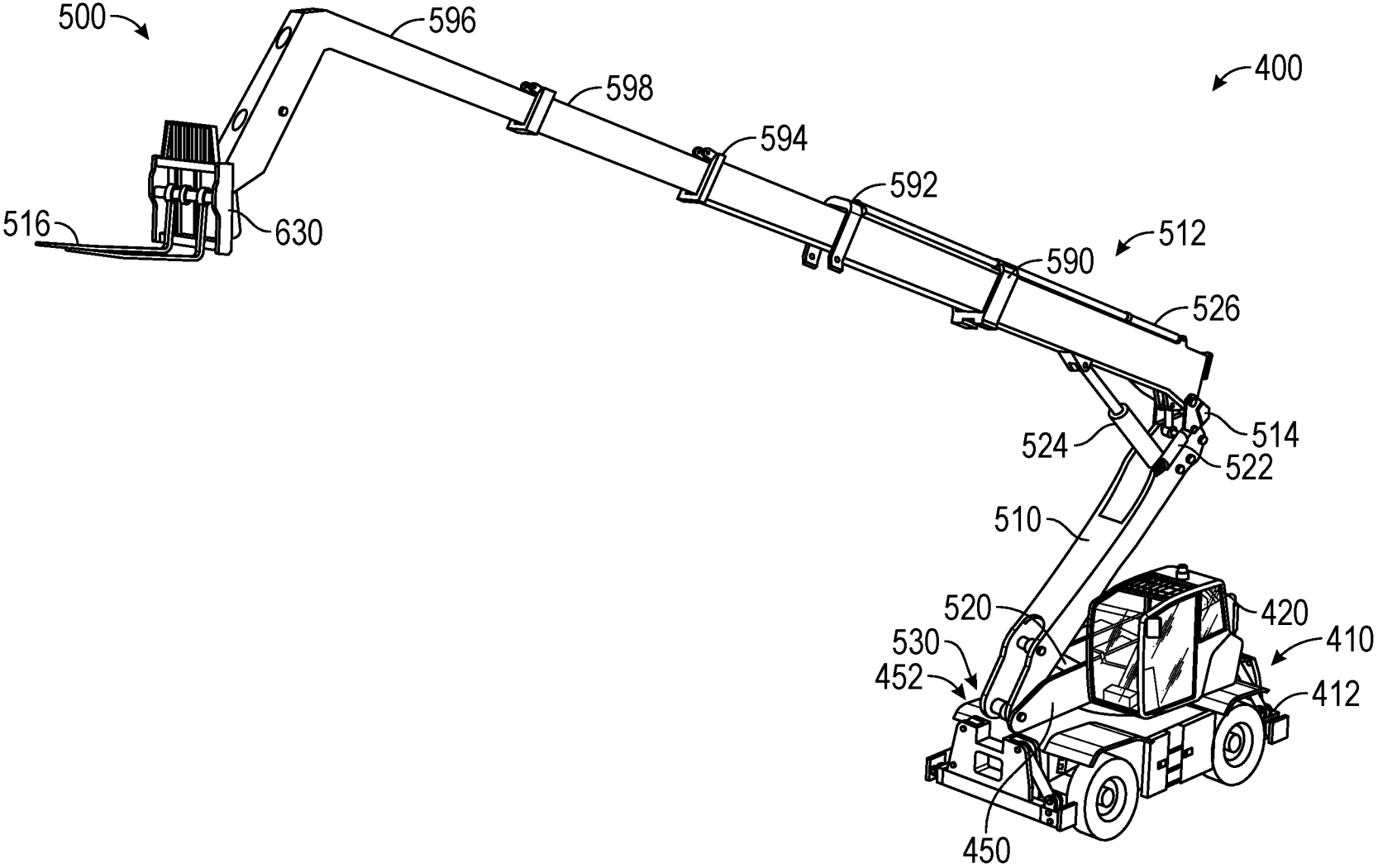
FIG. 9 is another front perspective view of the telehandler of FIG. 8.

Referring to FIGS. 8 and 9, a telehandler 400 is shown as an alternative embodiment to the telehandler 10. The telehandler 400 may be substantially similar to the telehandler 10 except as otherwise specified herein. The telehandler 400 includes a support structure, shown as frame assembly 410. The frame assembly 410 includes a chassis, shown as base frame assembly 412, having a front end 414 and a rear end 416 and that is supported by tractive elements 430. The base frame assembly 412 is directly coupled to a housing 424 containing a primary driver 432 and a pump 434. Near the front end 414 and the rear end 416, the base frame assembly 412 is directly coupled to outriggers 40 that are actuated by an actuator 442. The telehandler 400 further includes a cabin 420 and a boom assembly 500, and the frame assembly 410 further includes a platform, shown as turntable 450. Instead of directly coupling to the base frame assembly 412, the cabin 420 and the boom assembly 500 are directly coupled to the turntable 450. The turntable 450 is rotatable relative to the base frame assembly 412 about a vertical axis. In some embodiments, the turntable 450 is configured to rotate 360 degrees or more. The telehandler 400 includes an actuator (e.g., a hydraulic motor, an electric motor, a hydraulic cylinder, etc.) configured to rotate the turntable 450 relative to the base frame assembly 412 and may include a sensor configured to measure a rotational position of the turntable 450. Incorporation of the turntable 450 facilitates moving a payload circumferentially around a point without having to readjust the orientation of the base frame assembly 412.

The boom assembly 500 includes a tower boom 510, a telescoping assembly 512, an intermediate section 514, and an implement 516. A proximal end 530 of the tower boom 510 is pivotably coupled to a front end 452 of the turntable 450 (e.g., using as similar connection arrangement as the frame assembly 12 and the tower boom 110). A lower actuator 520, a pair of intermediate actuators 522, an upper actuator 524, and a telescoping actuator 526 actuate the boom assembly 500. The telescoping assembly 512 includes a base section 590, a first mid section 592, a second mid section 594, a fly section 596, and an interface 630 in a similar arrangement to the telescoping assembly 112. However, the telescoping assembly 512 further includes a third mid boom section, shown as third mid section 598, extending between the second mid section 594 and the fly section 596. Accordingly, the telescoping assembly 512 may include an additional cable and pulley arrangement to facilitate extension of the telescoping assembly 512. The third mid section 598 increases the length of the telescoping assembly 512 when fully extended.

Figure 10:
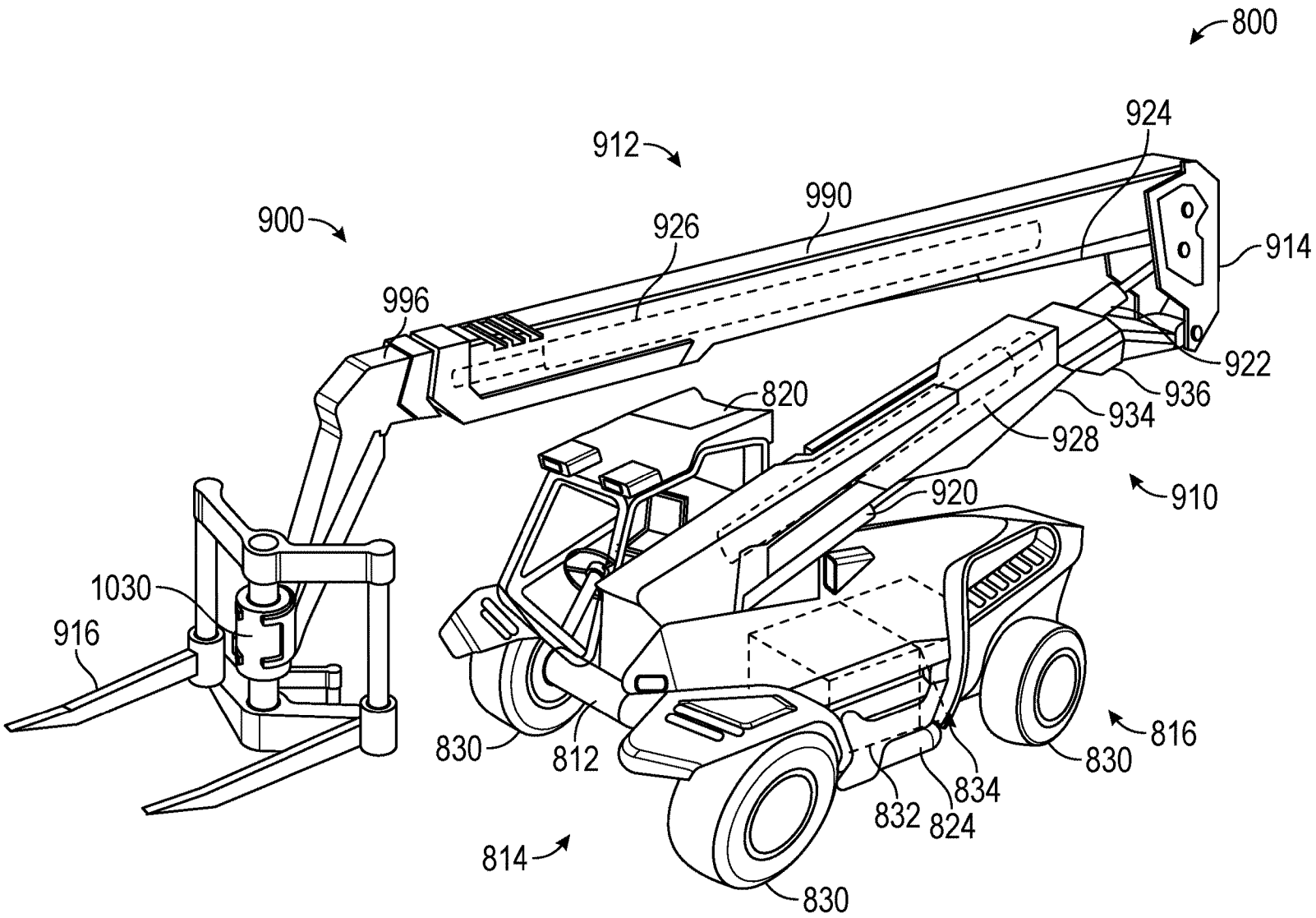
FIG. 10 is a front perspective view of a telehandler, according to yet another exemplary embodiment.

Referring to FIG. 10, a telehandler 800 is shown as an alternative embodiment to the telehandler 10. The telehandler 800 may be substantially similar to the telehandler 10 except as otherwise specified herein. The telehandler 800 includes a frame assembly 812 having a front end 814 and a rear end 816 and that is supported by tractive elements 830. The frame assembly 812 is coupled to a housing 824 containing a primary driver 832 and a pump 834. The telehandler 800 further includes a cabin 820 and a boom assembly 900 coupled to the frame assembly 812.

Referring again to FIG. 10, the boom assembly 900 includes a tower boom 910, a telescoping assembly 912, an intermediate section 914, and an implement 916. A lower actuator 920 rotates the tower boom 910 relative to the frame assembly 812. An intermediate actuator 922 rotates the intermediate section 914 relative to the tower boom 910. An upper actuator 924 rotates the telescoping assembly 912 relative to the intermediate section 914. A telescoping actuator 926 extends and retracts the telescoping assembly 912. In the embodiment shown in FIG. 10, the tower boom 910 is configured to telescope. Accordingly, the telehandler 800 further includes an actuator, shown as telescoping actuator 928, configured to extend a base boom section 934 and a fly boom section 936 relative to one another. The base boom section 934 is pivotably coupled to the frame assembly 812, and the fly boom section 936 is pivotably coupled to the intermediate section 914. As shown in FIG. 10, the telescoping actuator 928 is located inside of the tower boom 910. The telescoping assembly 912 includes a base section 990 and a fly section 996 configured to telescope relative to one another, omitting the mid boom sections shown in other embodiments. An interface 1030 couples the implement 916 to the fly section 996.

Figure 11:
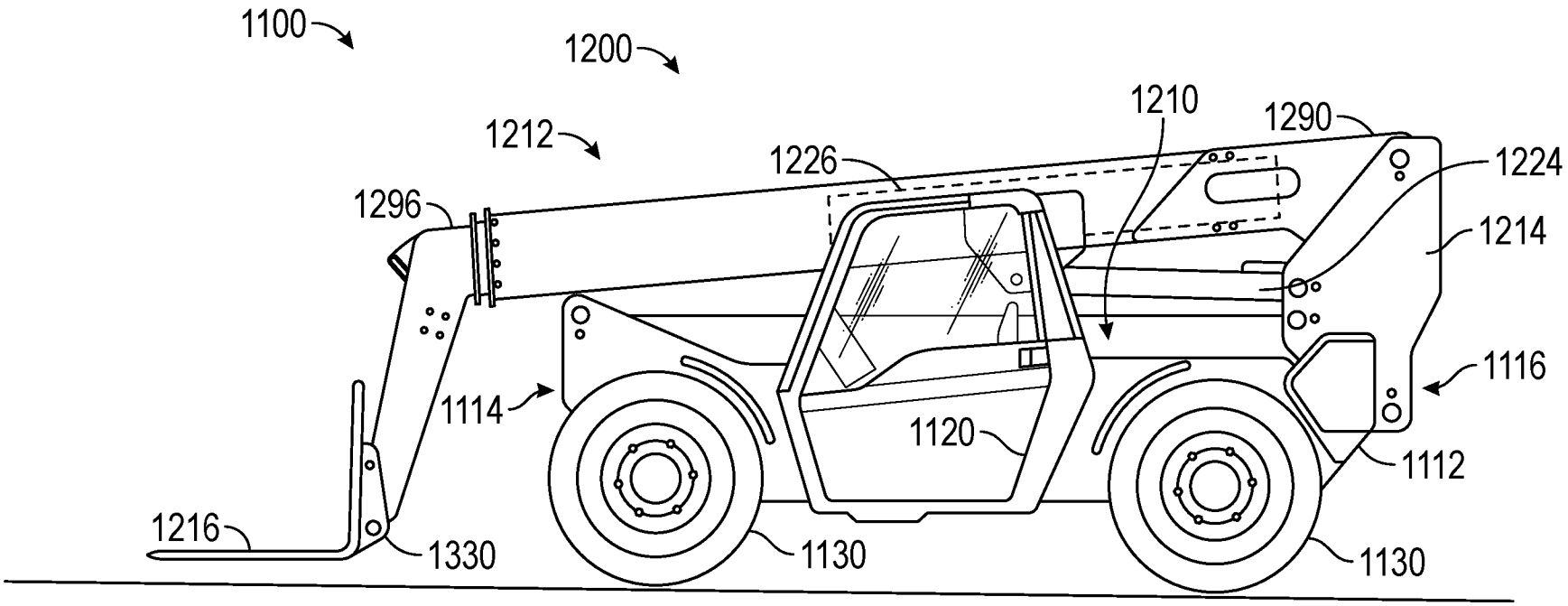
FIG. 11 is a side view of a telehandler, according to yet another exemplary embodiment.
Figure 12:
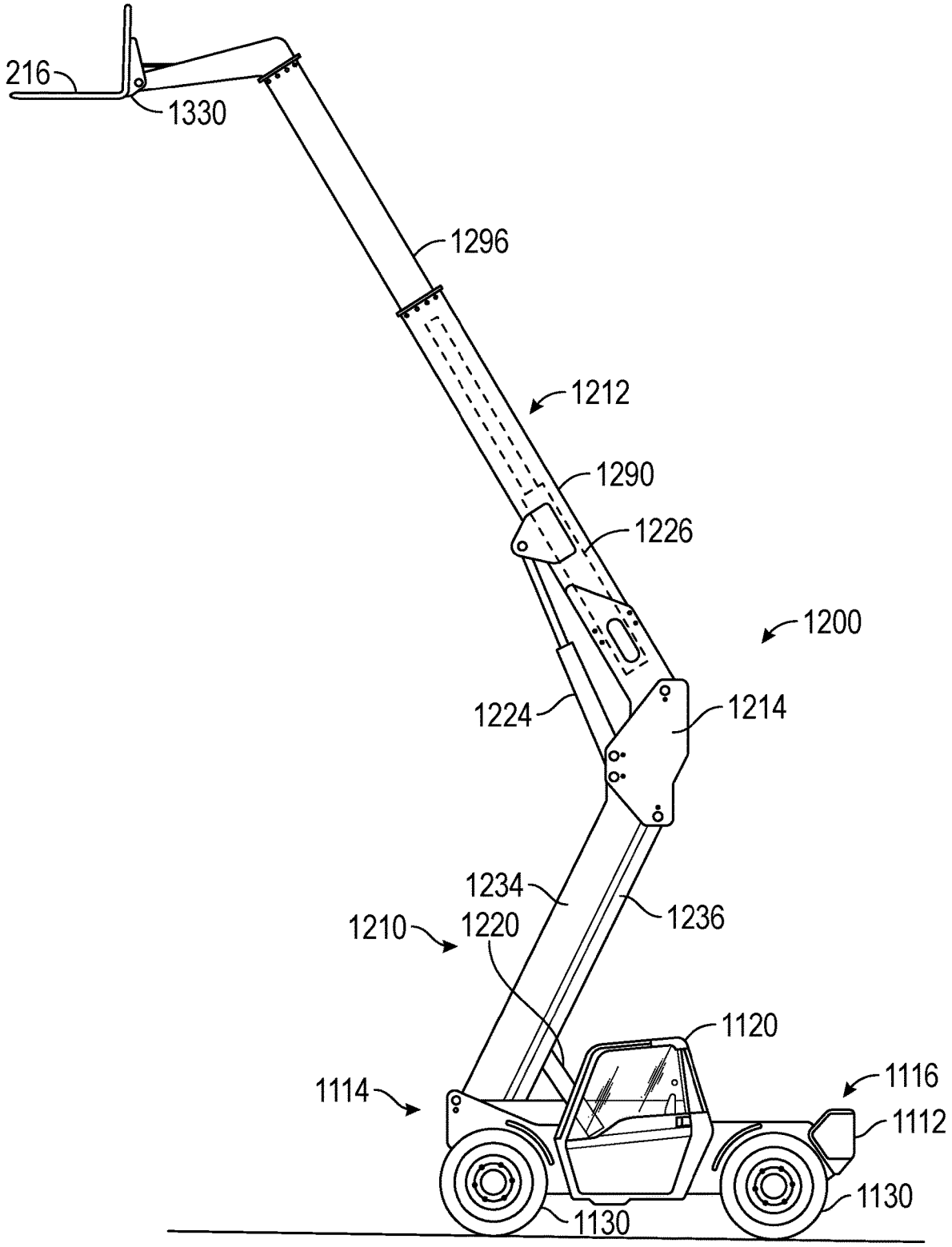
FIG. 12 is another side view of the telehandler of FIG. 11.

Referring to FIGS. 11 and 12, a telehandler 1100 is shown as an alternative embodiment to the telehandler 10. The telehandler 1100 may be substantially similar to the telehandler 10 except as otherwise specified herein. The telehandler 1100 includes a frame assembly 1112 having a front end 1114 and a rear end 1116 and that is supported by tractive elements 1130. The frame assembly 1112 may be coupled to a housing containing a primary driver and a pump. The telehandler 1100 further includes a cabin 1120 and a boom assembly 1200 coupled to the frame assembly 1112. FIG. 11 shows the boom assembly 1200 in a collapsed or stored configuration, and FIG. 12 shows the boom assembly 1200 extended into a use configuration.

Referring again to FIGS. 11 and 12, the boom assembly 1200 includes a tower boom 1210, a telescoping assembly 1212, an intermediate section 1214, and an implement 1216. A lower actuator 1220 rotates the tower boom 1210 relative to the frame assembly 1112. An upper actuator 1224 rotates the telescoping assembly 1212 relative to the intermediate section 1214. A telescoping actuator 1226 extends and retracts the telescoping assembly 1212. In the embodiment shown in FIGS. 11 and 12, the tower boom 1210 includes an upper member 1234 and a lower member 1236. The upper member 1234 and the lower member 1236 are both pivotably coupled to the frame assembly 1112 and the intermediate section 1214, forming a four bar linkage. Accordingly, the intermediate section 1214 and the tower boom 1210 have a fixed range of motion relative to one another (i.e., motion of one causes a predefined motion of the other). The lower actuator 1220, which may be coupled to either the upper member 1234 or the lower member 1236, controls the motion of the tower boom 1210 and the intermediate section 1214, and the intermediate actuator is omitted. The telescoping assembly 1212 includes a base section 1290 and a fly section 1296 configured to telescope relative to one another, omitting the mid boom sections shown in other embodiments. An interface 1330 couples the implement 1216 to the fly section 1296.

Figure 13:
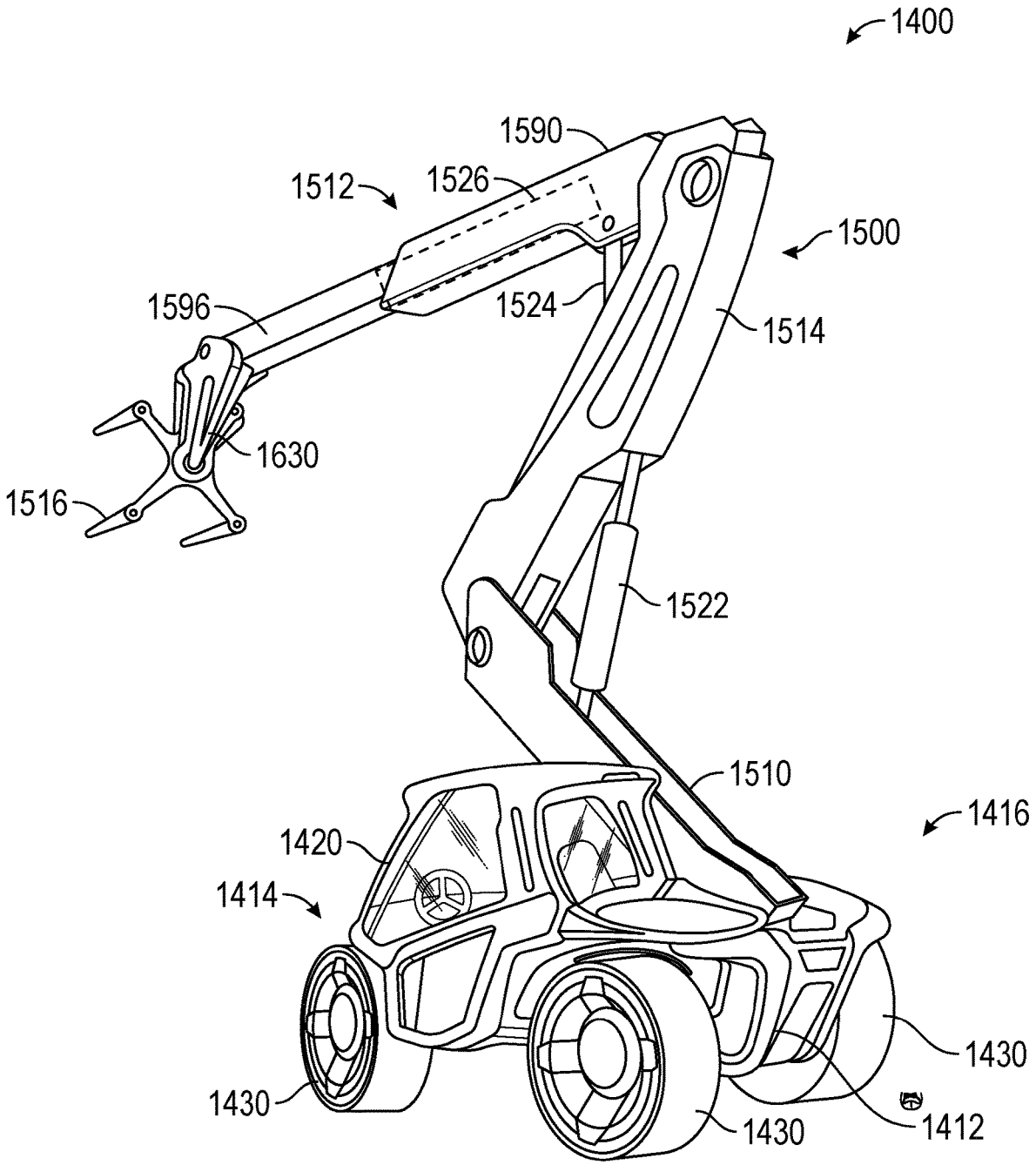
FIG. 13 is a rear perspective view of a telehandler, according to yet another exemplary embodiment.

Referring to FIG. 13, a telehandler 1400 is shown as an alternative embodiment to the telehandler 10. The telehandler 1400 may be substantially similar to the telehandler 10 except as otherwise specified herein. The telehandler 1400 includes a frame assembly 1412 having a front end 1414 and a rear end 1416 and that is supported by tractive elements 1430. The frame assembly 1412 may be coupled to a housing containing a primary driver and a pump. The telehandler 1400 further includes a cabin 1420 and a boom assembly 1500 coupled to the frame assembly 1412. In some embodiments, the telehandler 1400 includes a turntable similar to the turntable 450 to facilitate rotation of the boom assembly 1500 about a vertical axis. In such embodiments, the boom assembly 1500 is coupled to a rear end of the turntable.

Referring again to FIG. 13, the boom assembly 1500 includes a tower boom 1510, a telescoping assembly 1512, an intermediate section 1514, and an implement 1516. Instead of coupling near the front end 1414 of the frame assembly 1412, similar to the telehandler 10, the tower boom 1510 is pivotably coupled to the rear end 1416. In the stored position, the tower boom 1510 extends toward the front end 1414. The intermediate section 1514 is longer than the intermediate section 114 to facilitate connecting to the telescoping assembly 1512 in a similar location to the telehandler 10. When in the stored position, the intermediate section 1514 extends toward the rear end 1416, lying atop the tower boom 1510. A lower actuator rotates the tower boom 1510 relative to the frame assembly 1412. An intermediate actuator 1522 rotates the intermediate section 1514 relative to the tower boom 1510. An upper actuator 1524 rotates the telescoping assembly 1512 relative to the intermediate section 1514. A telescoping actuator 1526 extends and retracts the telescoping assembly 1512. The telescoping assembly 1512 includes a base section 1590 and a fly section 1596 configured to telescope relative to one another, omitting the mid boom sections shown in other embodiments. An interface 1630 couples the implement 1516 to the fly section 1596.

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the terms "exemplary" and "example" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like, as used herein, mean the joining of two members directly or indirectly to one another. Such joining may be stationary (e.g., permanent, etc.) or moveable (e.g., removable, releasable, etc.). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," "between," etc.) are merely used to describe the orientation of various elements in the figures. It should be noted that the orientation of various elements may differ according to other exemplary embodiments, and that such variations are intended to be encompassed by the present disclosure.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

It is important to note that the construction and arrangement of the systems as shown in the exemplary embodiments is illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements. It should be noted that the elements and/or assemblies of the components described herein may be constructed from any of a wide variety of materials that provide sufficient strength or durability, in any of a wide variety of colors, textures, and combinations. Accordingly, all such modifications are intended to be included within the scope of the present inventions. Other substitutions, modifications, changes, and omissions may be made in the design, operating conditions, and arrangement of the preferred and other exemplary embodiments without departing from scope of the present disclosure or from the spirit of the appended claim.

The invention claimed is:

1. A lift device, comprising:

a frame;

a boom assembly, comprising:

a first boom section having a proximal end pivotably coupled to the frame and a distal end opposite the proximal end, the first boom section configured to pivot relative to the frame about a substantially horizontal axis; and a second boom section pivotably coupled to the distal end of the first boom section; and an actuator configured to directly couple with the first boom section and the second boom section and transitionable between a locked configuration and an unlocked configuration, wherein the actuator permits the boom assembly to move freely when the actuator is in the unlocked configuration, and wherein, in the locked configuration, the actuator directly couples the second boom section to the frame such that the actuator limits movement of the first boom section relative to the frame.

2. The lift device of claim 1, wherein the first boom section is a lower boom section, wherein the second boom section is an intermediate boom section, and wherein the boom assembly further comprises an upper boom section coupled to the intermediate boom section.

3. The lift device of claim 2, wherein the upper boom section includes at least two telescoping boom sections slidably coupled to one another and configured to vary an overall length of the upper boom section.

4. The lift device of claim 1, wherein at least one of:

the second boom section defines a first aperture, and the actuator extends into the first aperture when the actuator is in the locked configuration; and the frame defines a second aperture, and the actuator extends into the second aperture when the actuator is in the locked configuration.

5. The lift device of claim 4, wherein the actuator extends into both the first aperture and the second aperture when the actuator is in the locked configuration.

6. The lift device of claim 1, wherein the actuator is directly coupled to the frame and the second boom section at least when the actuator is in the locked configuration.

7. The lift device of claim 1, wherein the actuator is a hydraulic actuator.

8. The lift device of claim 1, wherein the frame includes a base frame and a turntable rotatably coupled to the base frame, and wherein a cabin and the proximal end of the first boom section are coupled to the turntable.

9. The lift device of claim 1, further comprising a controller operatively coupled to the actuator, wherein the controller is configured to prevent the actuator from changing from the locked configuration to the unlocked configuration based on at least one of:

a weight of a payload supported by the boom assembly;

an orientation of the frame relative to a level orientation;

a position of an outrigger coupled to the frame; and a portion of the weight of the lift device supported by the outrigger.

10. A lift device, comprising:

a frame;

a boom assembly, comprising:

a base boom section having a proximal end pivotably coupled to the frame and a distal end opposite the proximal end, the base boom section configured to pivot relative to the frame about a substantially horizontal axis;

a telescoping assembly having a proximal end coupled with the base boom section;

an intermediate boom section pivotably coupled at a proximal end with the distal end of the base boom section and pivotably coupled at a distal end with the proximal end of the telescoping assembly; and a controller configured to reconfigure the boom assembly between a high lift mode and a high capacity mode, wherein the base boom section is free to move relative to the frame when the boom assembly is in the high lift mode, wherein the controller is configured to limit movement of the base boom section when the boom assembly is in the high capacity mode by operating an actuator to directly couple the intermediate boom section with the frame, and wherein the telescoping assembly and the intermediate boom section are free to move relative to the frame when the boom assembly is in the high capacity mode.

11. The lift device of claim 10, wherein the actuator is a first actuator and the lift device further comprises a second actuator coupled to the base boom section and the frame, wherein the second actuator is configured to move the base boom section relative to the frame, and wherein the controller is configured to limit movement of the second actuator when the boom assembly is in the high capacity mode.

12. The lift device of claim 10, wherein the actuator is operatively coupled to the controller, wherein the actuator is positioned to selectively engage the intermediate boom section of the boom assembly and the frame to prevent movement of the base boom section relative to the frame, and wherein the controller is configured to control the actuator to engage the at least one of the boom assembly and the frame when the boom assembly is in the high capacity mode.

13. The lift device of claim 10, further comprising an outrigger coupled to the frame and an outrigger sensor operatively coupled to the controller, wherein the outrigger is selectively reconfigurable between a stored position and a deployed position, wherein in the deployed position the outrigger engages the ground to support a portion of a weight of the lift device, wherein the outrigger sensor is configured to provide at least one of (a) information relating to a position of the outrigger and (b) information relating to a weight supported by the outrigger, and wherein at least one of:

the controller is configured to prevent the boom assembly from exiting the high capacity mode if the outrigger is not in the deployed position; and the controller is configured to prevent the boom assembly from exiting the high capacity mode if the weight supported by the outrigger is less than a threshold weight.

14. The lift device of claim 10, further comprising a sensor operatively coupled to the controller and configured to provide information relating to an angular orientation of the frame, wherein the controller is configured to prevent the boom assembly from exiting the high capacity mode if the angular orientation of the frame is outside of a predetermined range of angular orientations.

15. The lift device of claim 14, wherein the controller is configured to prevent the boom assembly from exiting the high capacity mode if the angular orientation of the frame is offset more than a threshold angle from a level orientation.

16. The lift device of claim 10, further comprising a sensor operatively coupled to the controller and configured to provide information relating to a weight of a payload supported by the boom assembly, and wherein the controller is configured to prevent the boom assembly from exiting the high capacity mode if the weight of the payload is greater than a threshold weight.

17. The lift device of claim 10, wherein the intermediate boom section is configured to indirectly couple the telescoping assembly with the base boom section.

18. The lift device of claim 10, wherein the frame includes a base frame and a turntable rotatably coupled to the base frame, and wherein a cabin and the proximal end of the base boom section are coupled to the turntable.

19. A boom assembly for a lift device, comprising:

an intermediate boom section;

a base boom section having:

a proximal end configured to be pivotably coupled to a frame of the lift device so that the base boom section is configured to pivot relative to the frame about a first axis that is substantially horizontal; and a distal end opposite the proximal end of the base boom section, wherein the distal end of the base boom section is pivotably coupled to the intermediate boom section such that the base boom section rotates about a second axis relative to the intermediate boom section;

an upper boom section having a proximal end pivotably coupled to the intermediate boom section such that the upper boom section rotates about a third axis relative to the intermediate boom section, wherein the second axis is offset from the third axis; and an actuator positioned to engage the intermediate boom section to directly couple the intermediate boom section with the frame to selectively limit movement of the base boom section relative to the frame about the first axis.

20. The boom assembly of claim 19, wherein the actuator is positioned to engage both the frame and the intermediate boom section to prevent movement of both the intermediate boom section and the base boom section relative to the frame.

* * * * *